US007624486B2

(12) United States Patent
Kaneko et al.

(10) Patent No.: US 7,624,486 B2
(45) Date of Patent: Dec. 1, 2009

(54) BUTTON MANUFACTURING DEVICE

(75) Inventors: Kenji Kaneko, Funabashi (JP); Kaori Ojima, Hitachinaka (JP); Kenetsu Kikuchi, Nagareyama (JP); Iwakichi Ogawa, Kashiwa (JP)

(73) Assignees: Bandai Co., Ltd., Tokyo (JP); Kikuchi Co., Ltd., Chiba (JP)

( * ) Notice: Subject to any disclaimer, the term of this patent is extended or adjusted under 35 U.S.C. 154(b) by 870 days.

(21) Appl. No.: 10/504,957

(22) PCT Filed: Feb. 14, 2003

(86) PCT No.: PCT/JP03/01586

§ 371 (c)(1),
(2), (4) Date: Mar. 22, 2005

(87) PCT Pub. No.: WO03/070046

PCT Pub. Date: Aug. 28, 2003

(65) Prior Publication Data

US 2005/0155218 A1 Jul. 21, 2005

(30) Foreign Application Priority Data

| | | |
|---|---|---|
| Feb. 19, 2002 | (JP) | 2002-42396 |
| Jun. 10, 2002 | (JP) | 2002-169258 |
| Jun. 12, 2002 | (JP) | 2002-172100 |
| Jun. 25, 2002 | (WO) | PCT/JP02/06361 |
| Nov. 1, 2002 | (JP) | 2002-320454 |

(51) Int. Cl.
*B21F 45/28* (2006.01)
*B23P 19/02* (2006.01)
*A44B 1/06* (2006.01)

(52) U.S. Cl. ..... 29/4; 29/251; 29/256; 29/525; 79/1

(58) Field of Classification Search ..... 29/4, 29/251, 256, 525; 40/1.5, 1.6; 79/1; 100/48, 100/50
See application file for complete search history.

(56) References Cited

U.S. PATENT DOCUMENTS

| | | | | |
|---|---|---|---|---|
| 1,765,325 A | | 6/1930 | Day | |
| 4,532,684 A | * | 8/1985 | Roebuck | 29/4 |
| 5,067,265 A | | 11/1991 | Harms | |

(Continued)

FOREIGN PATENT DOCUMENTS

| | | |
|---|---|---|
| CH | 2554 A | 12/1890 |

(Continued)

*Primary Examiner*—David P Bryant
*Assistant Examiner*—Sarang Afzali
(74) *Attorney, Agent, or Firm*—Smith Patent Office

(57) ABSTRACT

The present invention relates to a button manufacturing device that is lightweight and robust, and that can be operated even at an unstable location and in a small space. A button manufacturing device comprises a base, a slide platform disposed on the base for reciprocating movement, first and second lower dies provided on both sides of the slide platform in the reciprocating directions, a press screw shaft capable of moving in the axial direction by screwing into a female screw section provided on a beam fixed to the upper part of struts, fixed on the base, an upper die provided on a lower end of the press screw shaft for joining to the first lower die or the second lower die, and an operating handle provided on an upper part of the press screw shaft.

2 Claims, 26 Drawing Sheets

U.S. PATENT DOCUMENTS 5,283,966 A 2/1994 Rader et al.

FOREIGN PATENT DOCUMENTS

| | | | | |
|---|---|---|---|---|
| CH | 8401 | A | | 10/1894 |
| FR | 1 295 402 | A | | 6/1962 |
| GB | 2205772 | A | * | 12/1988 |
| JP | 58-218906 | A | | 12/1983 |
| JP | 61-29606 | U | | 2/1986 |
| JP | 2-94609 | U | | 7/1990 |
| JP | 7-33450 | U | | 6/1995 |
| JP | 8-145234 | A | | 6/1996 |

* cited by examiner

BUTTON MANUFACTURING DEVICE

BACKGROUND OF THE INVENTION

1. Field of the Invention

The present invention relates to a button comprising a button body having an insignia such as a logotype, a design or a pattern applied, and an attachment means such as a removable pin enabling attachment of the button to clothing, a hat, etc., and to a device for manufacturing such a button.

2. Discussion of the Related Art

As shown in FIGS. 21(*a*) and 21(*b*), a button of the related art comprises a button body 200*a* having an insignia 215 of a logotype, a design or a pattern applied, and an attachment means 229 such as a removable pin enabling attachment of the button to clothing or a hat, etc. The button body 200*a* is made up of a rear cover 205 and a front cover 201, and is formed so that the peripheries of a design paper 211 and a transparent cover (sheet member) 213 placed on an upper surface of the front cover 201 are inserted between an edge 203 of the front cover 201 and an edge 209 of the rear cover 205. The insignia 215 of a logotype, a design or a pattern, etc. is printed on the design paper 211. The rear cover 205 is provided with a coupling member 260, such as a pair of holes 261, 261, for mounting an attachment means 229 such as a removable pin. This related art button is manufactured using a manufacturing device as disclosed in Japanese Patent Laid-open Patent Publication No. 61-32005A.

This manufacturing device comprises a base, an arm fixed to the base, a pressing mold assembly attached to a tip of the arm which is moved up and down by a handle, a plate provided rotatably on the base, and first and second lower die assemblies provided on the plate. The press molding assembly is moved up and down by a pinion rotated by the handle and rack engaging with the pinion. Also, the button has a pair of holes through which a removable pin is coupled to the rear cover 205.

Since the above described button of the related art has the attachment means 229 secured to the coupling member such as a pair of holes 261, 261 preformed in the rear cover 205, the orientation of the insignia 215 applied to the button body 200*a* and the position of the means 229 such as a pin attaching the button in use are predetermined, and there is a problem that the position of the attachment means 229 cannot be changed with respect to the desired orientation of the insignia 215. With the above described related art device for manufacturing the prior art button, in manufacturing the button body 200*a*, the orientation of the insignia 215 applied to the button body 200*a* is often misaligned with the coupling member 260, such as a pair of holes 261, 261, etc. formed on the rear cover 205 (e.g., a position of the coupling member 260 is skewed to attain a desired orientation of the insignia 215; see FIG. 21(*c*)), and in these cases a position of the attachment means 229 secured to the coupling member 260 is also undesirable with respect to the orientation of the insignia 215, and the button, when attached by a pin 229 on clothing, or the like would have its front insignia undesirably oriented. This means that the button body 200*a* must be coupled with the member 260 after confirming the orientation of the insignia 215 in relation to the position of the coupling member 260, and this is a bothersome and time consuming task. Additionally, the button of the related art has a problem in that the attachment means 229 secured to the button body 200*a* is fixed, and it is also inconvenient that there is no alternative means that can be used.

Since the above described related art button manufacturing device has a problem with strength, parts such as a base and an arm are fabricated by casting, which results in the finished product being heavy and having a high price. Since a considerable force is required to press down the arm and the pressing force is acting on the base, instability of positioning of the base will disturb a normal operation, and the operation carried out on an unstable work platform might cause the base to slide off the work platform and break. Also, with the button manufacturing device of the related art, there is a problem that it is difficult to manufacture the button while confirming the orientation of the design paper attached to its front cover in relation with the position of the pair of holes formed in the rear cover. For this reason, when the removable pin was fitted into the pair of holes, the resultant button would have its design paper undesirably exhibited due to misadjustment in position with the attachment pin.

The present invention has been conceived in view of the above described problems, and an object of the invention is to provide a novel button which, in fitting an attachment means to a button body, is capable of altering a position of the attachment means as desired to appropriately orient a design or pattern insignia on the front surface of the button body. Another object of the invention is to provide a novel button where a coupling member can be selected from a plurality of alternatives such as a detachable pin, a clip, a magnet or the like. Additionally, in view of overcoming the above mentioned disadvantages, still another object of the present invention is to provide a button manufacturing device that is light, solid and produced at a low cost, does not take up much space and can be operated in an unstable installation location, and which is designed to be friendly even to a child user. In still another aspect of the invention, an improved button manufacturing device of highly safety-oriented design is provided that can protect a child user from accidentally pressing his or her finger. In still another aspect of the invention provided is an improved button manufacturing device of enhanced reliability which permits a useless load to be released after a specified machining procedure of manufacturing buttons.

SUMMARY OF THE INVENTION

In order to achieve the first object described above, a button defined in claim 1 has (I) a button body which comprises (i) a front cover having a substantially circular front plate and a cover edge extending downward from the front plate, (ii) a sheet member mounted on the front plate of the front cover, and (iii) a rear cover having a substantially circular rear plate and a cover edge extending downward from the rear plate, the button body having its front cover fitted on the rear cover, having its sheet member gripped at the periphery between the front and rear cover edges so as to cause a tight contact of the sheet member with the front plate, and (II) an attachment means capable of mounting the button on an item such as clothing, a hat, a bag, or the like, the attachment means being secured to the button body in a transverse position selected in the rear plate after the assembly of the front and rear covers into the button body.

In one aspect of the present invention, the button claimed herein has design paper which is printed with an insignia that is a logotype, a pattern or a design, or a combination of these and which is placed between the front plate of the front cover and the sheet member, and a selection of the transverse position of the attachment means across the rear plate depends upon a desired orientation of the insignia when the attachment means is in position to mount the button on the item such as clothing.

In another aspect, the button of the present invention comprises a button body with an insignia that is a logotype, a pattern or a design, or a combination of these, two or more types of attachment means capable of mounting the button on an item such as clothing, a hat, a bag, or the like, and a coupling member for securing the attachment means to the button body.

In still another aspect of the present invention, the button has an attachment means selected from a detachable pin, a clip, a magnet or the like.

In order to achieve the above described objects, the attachment means is secured to the button by means of a hole provided around the center of the rear plate and a raised element fitted in the hole.

Also, in accordance with the present invention, a button manufacturing device for fabricating the button is provided. The device is especially used to produce the button which is comprised of a rear cover with its cover edge extending upwardly by, a front cover with its cover edge extending downwardly by, and design paper and transparent sheet placed on top of the front cover, the front cover having its cover edge buckled while the design paper and the transparent sheet have their respective peripheries gripped between the cover edges of the front and rear covers. The device comprises a base, a slide platform capable of reciprocally moving on an upper surface of the base, first and second lower dies opposed to each other along the path of the reciprocal movement of the slide platform, a beam fixed to upper portions of struts above the slide platform, a press screw shaft fitted in the strut threaded in a female screw to screw up and down therethrough, an upper die located at a lower end of the press screw shaft and pressed onto the first and second lower dies, and an operating handle provided on an upper part of the press screw shaft. The first lower die comprises a first table where the front cover is placed, and a guide table surrounding the first table for carrying the design paper and transparent sheet laid one over another, the guide table being urged upward by an elastic member to move up and down, while the second lower die comprises a second table where the rear cover is placed, and a processing platform surrounding the second table for buckling a contact edge of the front cover onto the cover edge of the rear cover so that the periphery of the design paper and the transparent sheet is gripped by those edges of the front and rear covers, the processing platform being urged upward by an elastic member to move upward. The upper die comprises an outer frame, and a shallower inner frame located inside the outer frame, the inner frame being rotatable at a lower end of the press screw shaft passing an opening at an upper end of the outer frame. The upper die further comprises a switch member serving to switch to either the outer or inner frame pressed by the press screw shaft, depending upon positions of the first and second lower dies. When the first lower die is almost right below the upper die, the switch member latches onto the upper end of the outer frame and is pressed by the press screw shaft, or otherwise, when the slide table is moved to position the second lower die almost right below the upper die, the switch member leaves the upper end of the outer frame and is not pressed by the press screw shaft. In this button manufacturing device, the operating handle is turned to lower the press screw shaft, and pressing force against the switch member causes the outer frame to move down and bump against the guide table around the first lower die, which pushes the guide table down against a resistant force of the elastic member until the print paper and the transparent sheet are bent over the contact edge of the front cover. On the contrary, with the switch member dislocated from the press contact with the screw shaft, the inner frame is forced downward to bump against the processing table around the second lower die, which pushes the processing table down against the elasticity of an elastic member until the contact edge of the front cover is buckled onto the contact edge of the rear cover so that the print paper and the transparent sheet have their respective peripheries gripped between the contact edges of the front and rear covers.

Also, a button manufacturing device according to the present invention produces a button primarily comprised of a front cover and a rear cover, and the device includes a base, a first static element on which the front cover is to be placed, a second static element on which the rear cover is to be placed, a dynamic element pressing the first and second static elements, respectively, to press mold the button, and a cover protecting the dynamic element and either one of the first and second static elements cooperative with the dynamic element from any access to them, the remaining one of the first and second static elements away from a work range of the cooperative elements being accessible.

The dynamic element is typically an upper die that is coupled to an end of a press shaft to press mold the button or its intermediate product, and the static elements are lower dies used cooperative with the upper die to press mold the button or its intermediate product.

Preferably, the button manufacturing device further comprises a slide platform mounted on the base and reciprocally sliding thereon, and the first and second static elements are first and second lower dies opposed to each other along the path of the reciprocal movement of the slide platform. The reciprocal movement of the slide platform enables the first and second lower dies to alternately reach the work range where they are cooperative with the dynamic element.

An alternative button manufacturing device according to the present invention produces a button primarily comprised of front and rear covers, and the device includes a base, a static element on which the front or rear cover is to be placed, the static element being positioned on the base, a dynamic element pressing the static element to press mold the button, a press shaft advancing or reversing the dynamic element relative to the static element to engage with or disengage from each other, and a beam coupled to the press shaft to aid the same in advancing and receding and also coupled to the base to endure a reaction force that results from the bumping and pressing impact of the dynamic element against the static element, the beam being displaced due to the reaction force that reaches a specified level as a result of the press shaft further advanced after the dynamic and static elements are, pressed thereby preventing an excessive reaction force from being applied beyond the level. Preferably, the beam is made of polycarbonate.

In this alternative embodiment, excessive stress is not applied to components of both the dynamic and static elements used to mold the button covers, and damage to the device can be avoided.

Another alternative button manufacturing device according to the present invention produces a button primarily comprised of front and rear covers, and the device includes a base, a static element on which the front cover is to be placed, the static element being positioned on the base, a dynamic element hammering the static element to press mold the front cover, a press shaft advancing or reversing the dynamic element relative to the static element to engage with or disengage from each other, and a beam coupled to the press shaft to aid the same in advancing and receding and also coupled to the base to endure a reaction force that results from the bumping and pressing impact of the dynamic element against the static element. The front cover, once placed between the dynamic element and the static element, being capable of moving relative to the dynamic element in compensation for misalignment of the vertical axis during the press molding operation. In this way, the front cover, even if placed eccentric from the vertical axis on the static element, can be reset in position, adjusted in position, and aligned adequately with the vertical axis. Since the press molding is carried out after such adjustment and alignment, the front cover or anything placed on the static element can be processed without misalignment with the vertical axis in the work range, regardless of its original setting on the static element.

Preferably, the dynamic element is partially made of plastic especially in an area which contacts an object or the front cover on the static element.

In this embodiment, preferably, a circular object or the front cover on the static element has its peripheral edge or cover edge curved and extended downward while the dynamic element has an inner surface complementary in shape to fit on the curved edge.

Still another alternative button manufacturing device according to the present invention produces a button primarily comprised of a front and a rear cover, and the device includes a base, a static element on which the front or rear cover is to be placed, the static element being positioned on the base, a dynamic element hammering the static element to press mold the button, a press shaft advancing or recessing the dynamic element relative to the static element to engage with or disengage from each other, a beam coupled to the press shaft to aid the same in advancing and receding and also coupled to the base to endure the reaction force that results from the bumping and pressing impact of the dynamic element against the static element, and a handle located at the top of the press shaft to be manipulated to control the advancement and recession of the press shaft. The press shaft has a male screw mated with a female screw provided in the beam so that control over the advancement, recession, and pressing of the press shaft relies on the turning of the handle, and the handle is adapted to rotate without an affect on any other elements so as not to cause the reaction force beyond a predetermined level as a result of further advancement of the press shaft once the dynamic element attains the desired engagement with the static element.

Preferably, the handle is linked to the press shaft with an intervening clutch mechanism, and the handle, after applying the turning force beyond the predetermined level, is disconnected from the press shaft and rotates by itself.

Preferably, the clutch mechanism includes recessed areas radially arranged in an inner member of the handle, spring members accommodated in the recessed areas, engagement pieces coupled to ends of the spring members, and additional recessed areas in an outer member of the handle used in combination to fit on the engagement members. In ordinary conditions, the engagement pieces keep fitted in the recessed areas in both the outer and inner members which are joined in the unit to rotate together, and when the turning force exceeds the predetermined level, the engagement pieces in the inner member are released from the recessed areas in the outer member due to that turning force, resulting in the outer member rotating independently.

The handle and the outer member may be integrally formed. Further another alternative button manufacturing device according to the present invention produces a button primarily comprised of a front and a rear cover, and the device includes a base, a static element on which the front or rear cover is to be placed, the static element being positioned on the base, a dynamic element pressing the static element to press mold the button, a press shaft advancing or reversing the dynamic element relative to the static element to engage with or disengage from each other, a beam coupled to the press shaft to aid the same in advancing and receding and also coupled to the base to endure the reaction force that results from the bumping and pressing impact of the dynamic element against the static element, and a handle located at the top of the press shaft and manipulated to control the advancing and retreating movement of the press shaft. The press shaft has a male screw mated with a female screw provided in the beam so that control over the advancing, retreating, and pressing of the press shaft relies on the turning of the handle, and the press shaft is unscrewed through the beam so as not to apply the reaction force beyond a predetermined level as a result of further advancement of the press shaft once the dynamic element attains the desired engagement with the static element.

Yet another alternative button manufacturing device according to the present invention produces a button primarily comprised of a front and a rear cover, and the device includes a base, a static element on which the front or rear cover is to be placed, the static element being positioned on the base, a dynamic element pressing the static element to press mold the button, a press shaft advancing or recessing the dynamic element relative to the static element to engage with or disengage from each other, a beam coupled to the press shaft to aid the same in advancing and retreating and also coupled to the base to endure the reaction force that results from the bumping and pressing impact of the dynamic element against the static element, and an alarm to let an operator know that the press shaft has advanced to attain the desired engagement of the dynamic element with the static element. This enables the operator to hear the alarm that the pressing force has attained the desired engagement to appropriately buckle the front and rear covers together or objects on the static element together. In this way, the operator can avoid applying undesirably excessive force and can prevent inadvertent damage to the device.

In this case, for instance, the alarm is comprised of a horizontally extending movable member applied to the press shaft and a knob fixed to the beam, and it gives an alarm to report an attainment of the desired engagement that is determined by a certain manner of contact of the movable member with the knob during the advancement of the press screw shaft.

More preferably, an alarm is given to report a disengagement of the dynamic element from the static element due to the retreating movement of the press shaft after the press molding is completed. This ensures enhanced reliability of the device.

DETAILED DESCRIPTION OF THE PREFERRED EMBODIMENTS

Figure 1:
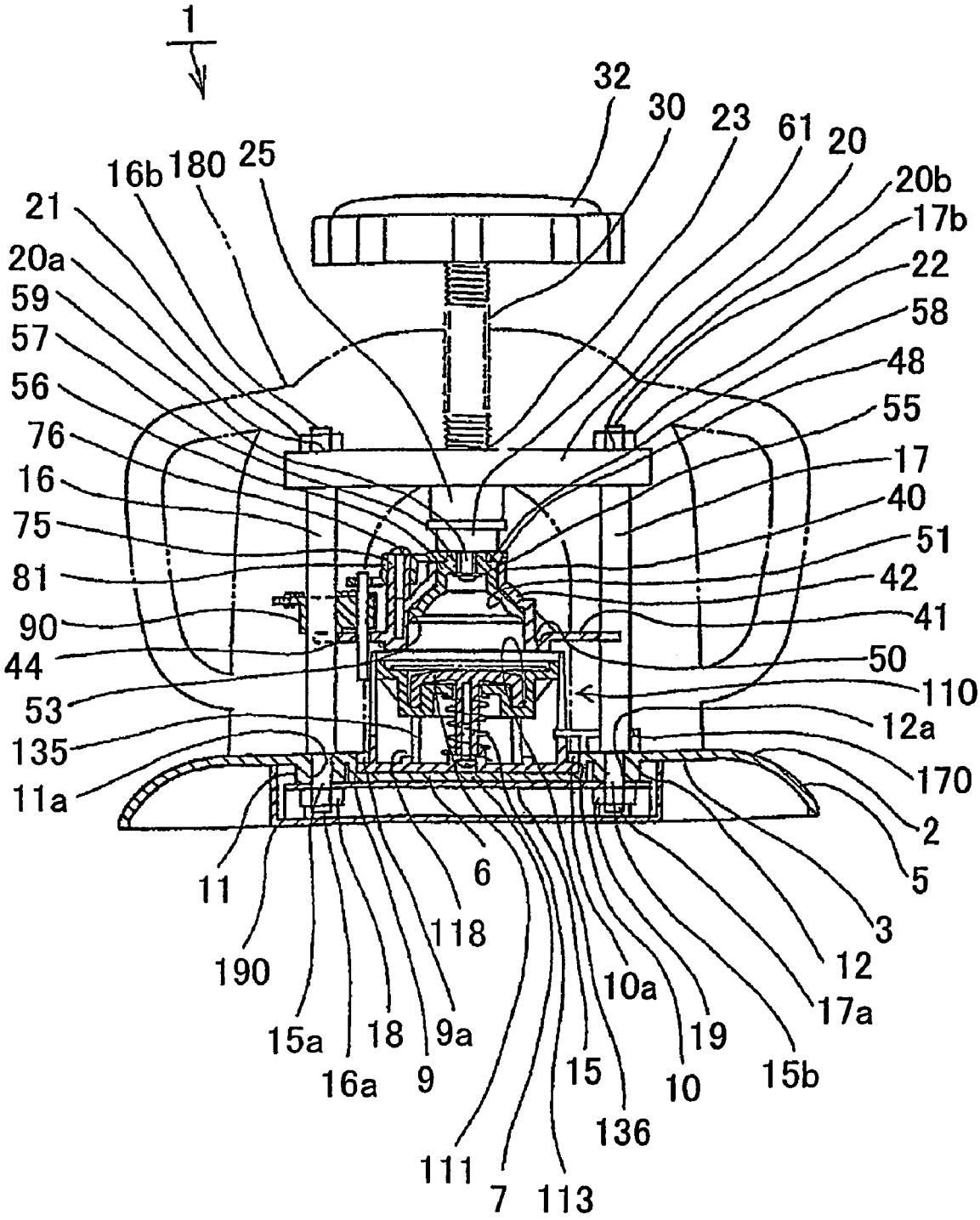
FIG. 1 is an overall front elevational view partly in cross section, showing a first lower die of a button manufacturing device of the present invention.
Figure 2:
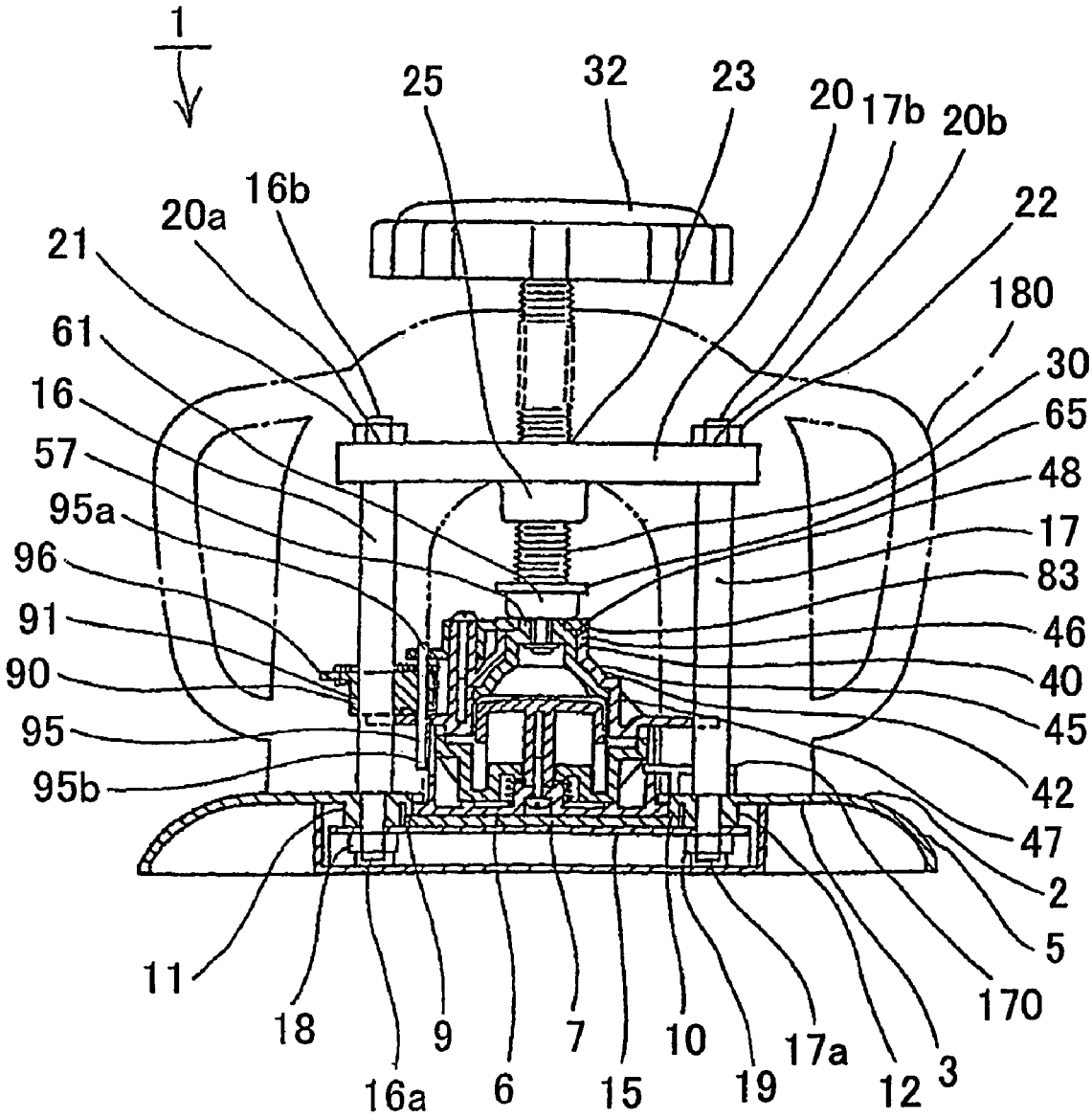
FIG. 2 is an overall front elevational view partly in cross section, for describing a movement in contrast with FIG. 1.
Figure 3:
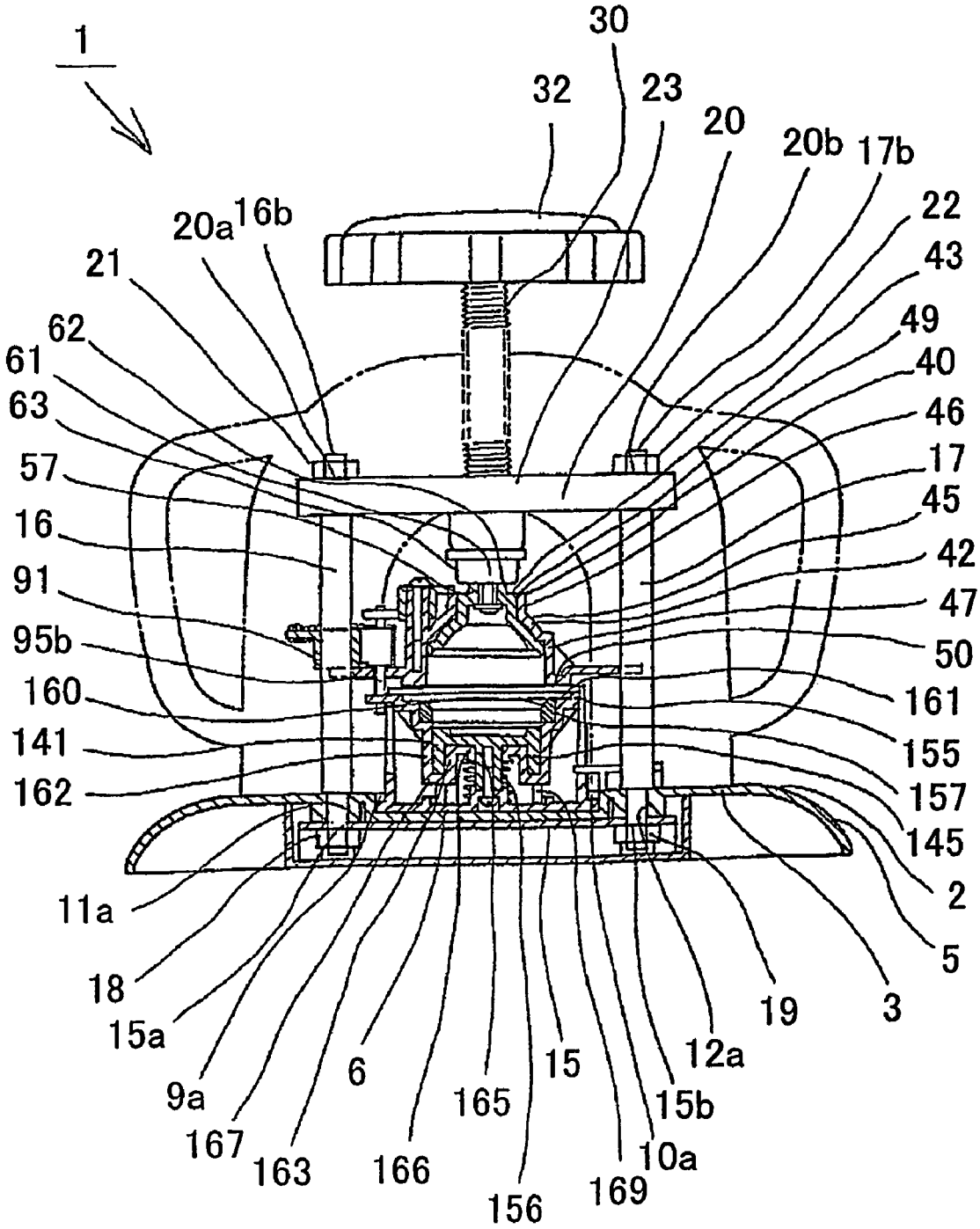
FIG. 3 is an overall front elevational view in cross section, showing a second lower die of a button manufacturing device of the present invention.
Figure 4:
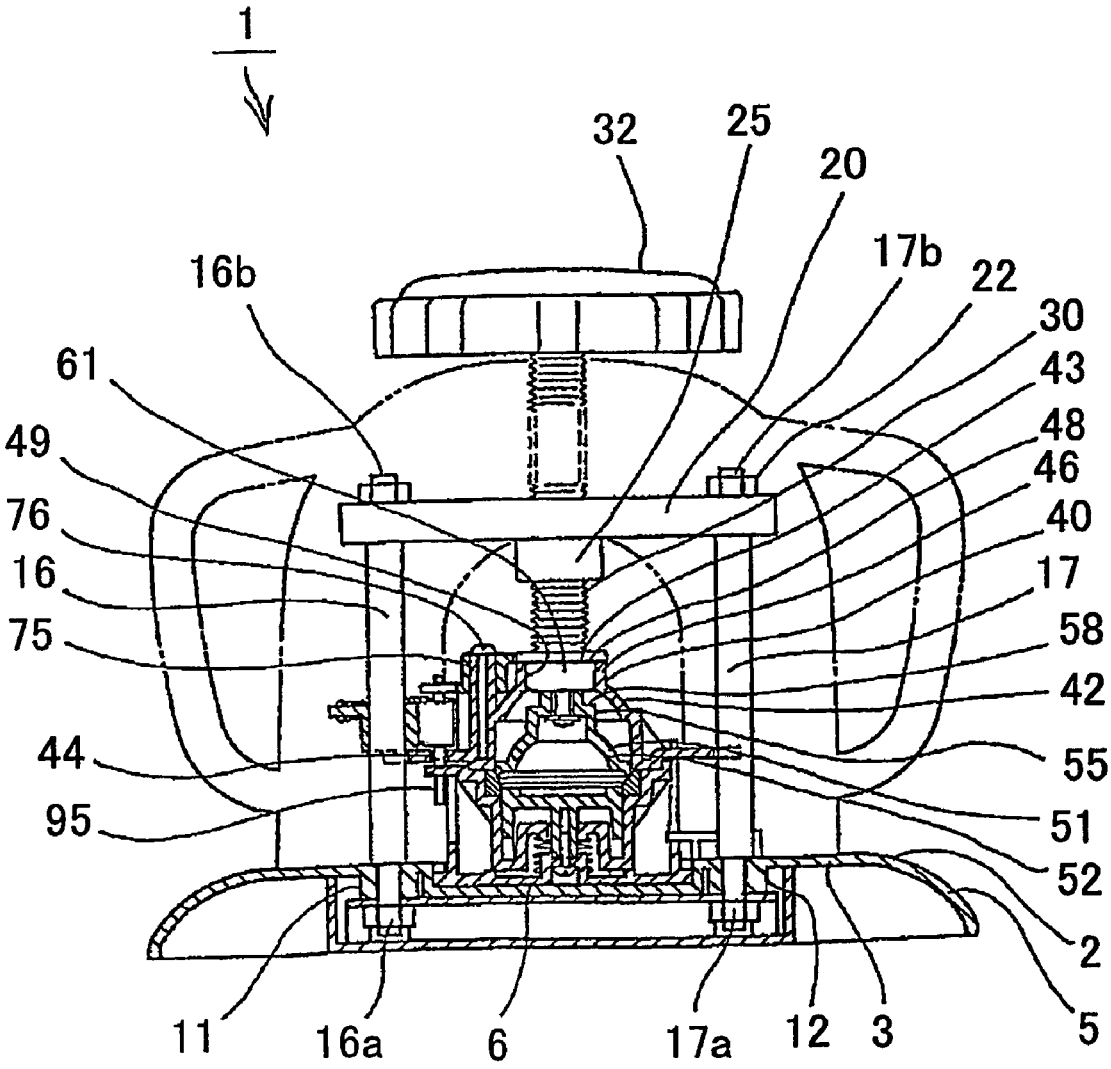
FIG. 4 is an overall front elevational view partly in cross section, for describing a movement in contrast with FIG. 3.
Figure 5:
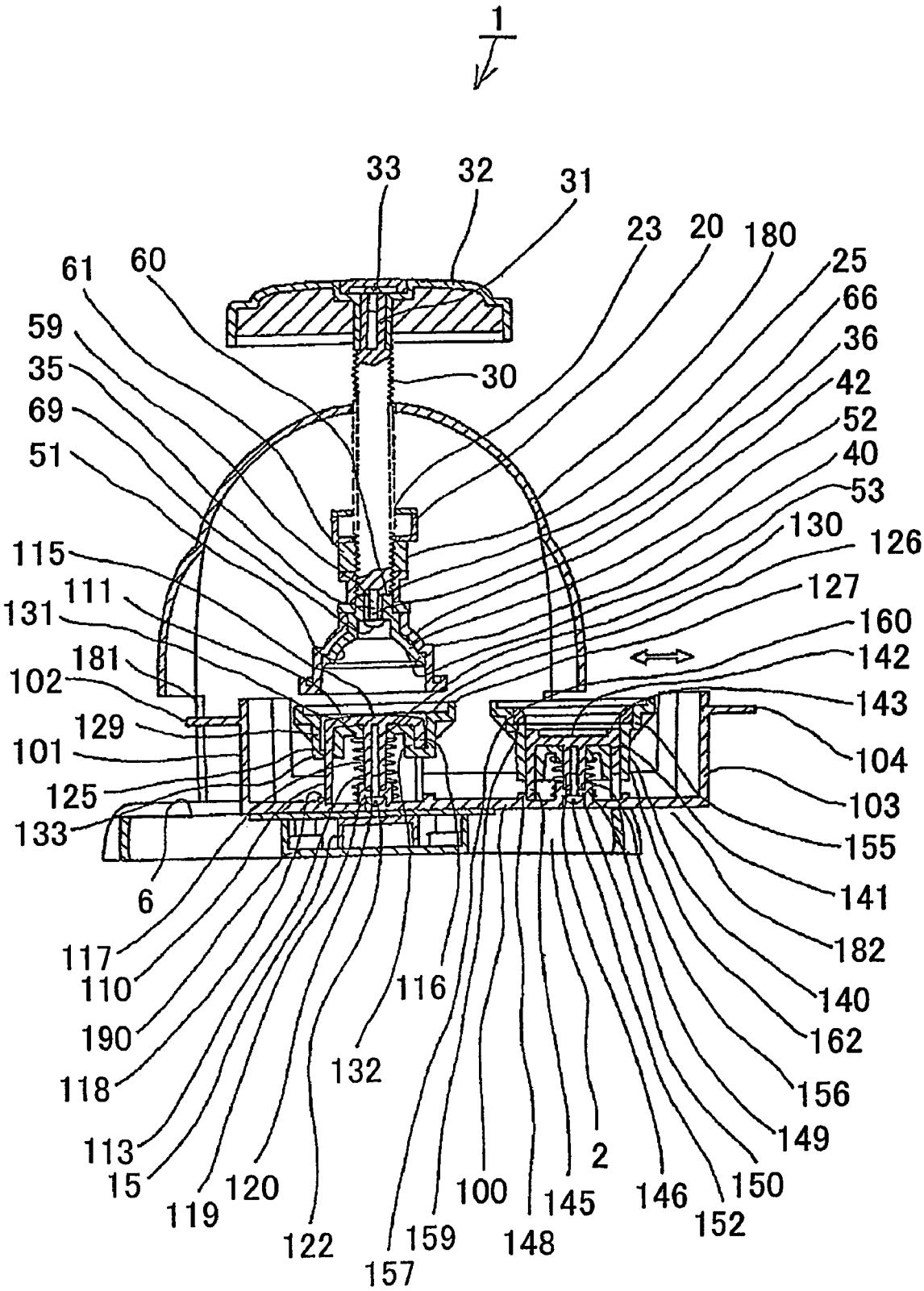
FIG. 5 is an overall side cross sectional view showing the button manufacturing device of the present invention.
Figure 6:
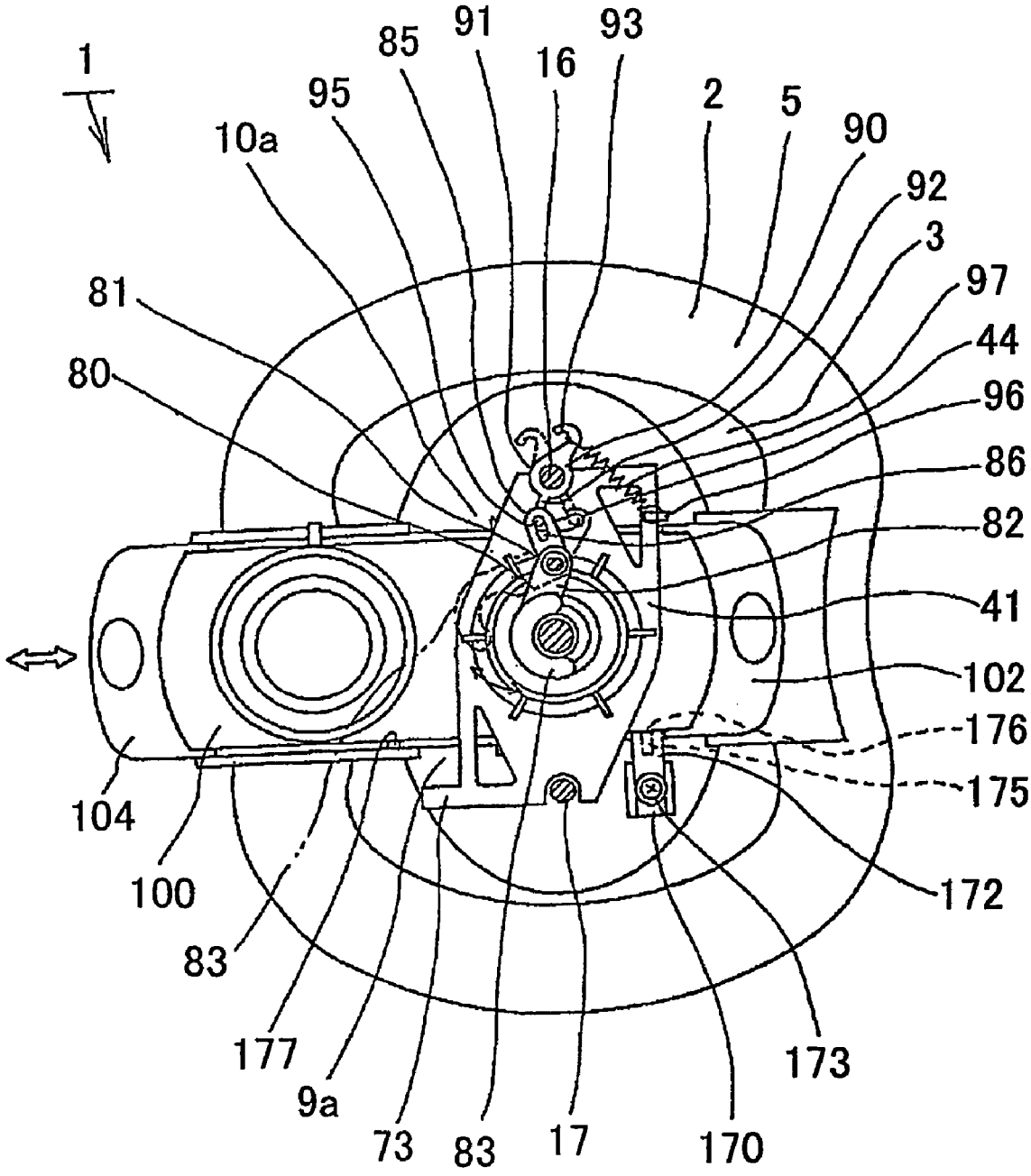
FIG. 6 is a top plan view of FIG. 5.
Figure 7:
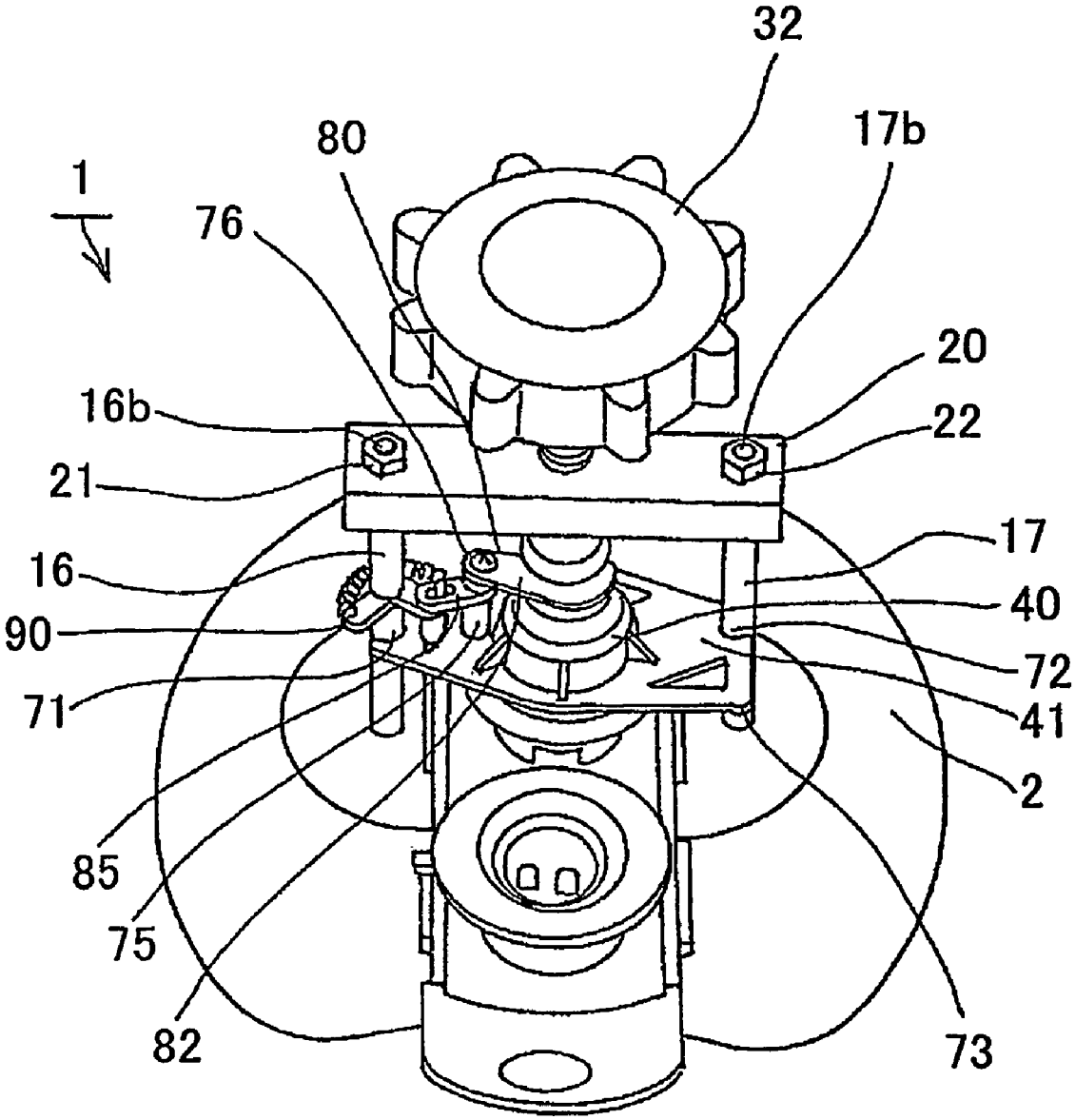
FIG. 7 is a perspective view for describing the movement of the button manufacturing device.
Figure 8:
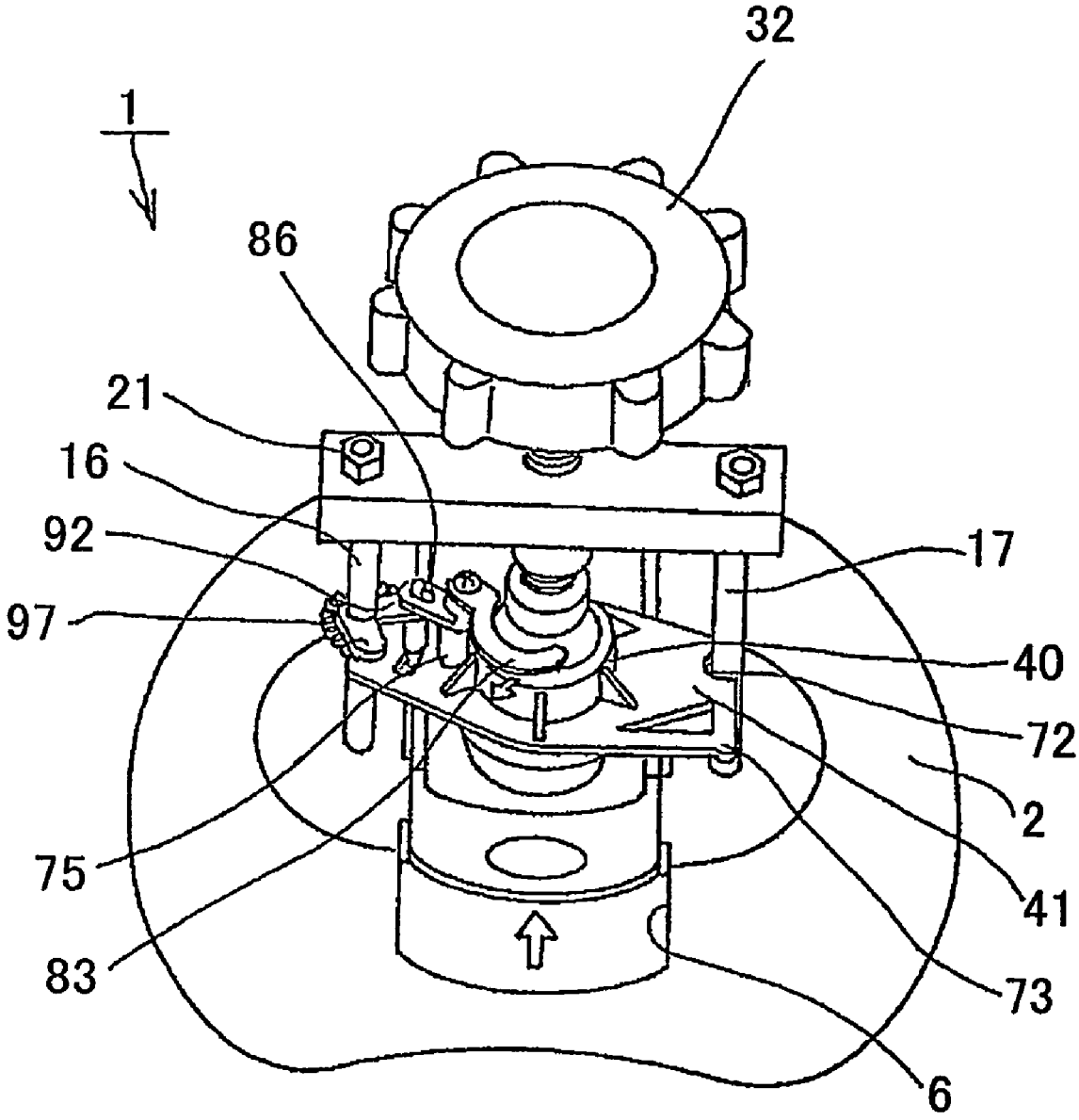
FIG. 8 is a perspective view for describing the movement of the button manufacturing device.

One embodiment of a button of the present invention will now be described in conjunction with FIGS. 11 to 20. A button 200 comprises a button body 200*a* and any of attachment means 229, 237, 246. The button body 200*a* is comprised of a front cover 201 having a substantially circular front plate 202 and a front cover edge 203 extending further downwards from the front plate 202, a sheet member 213 mounted on the front plate 202 of the front cover 201, and a rear cover 205 having a substantially circular rear plate 206 and a rear cover edge 209 extending further upwards from the rear plate 206, and the rear cover 205 is fitted into the front cover 201 so that the sheet member 213 is gripped at its periphery between the rear cover edge 209 and the front cover edge 203 so as to bring the sheet member 213 into tight contact with the front plate 202. The attachment means 229, 237, 246 are used to mount the button on an item such as clothing, a hat or a bag, and a selected one of the attachment means 229, 237, 246 is secured to the button body 200*a* in a transverse position in the rear plate 206 (e.g., in X direction, Y direction or Z direction—refer to FIG. 11) after the assembly of the front and rear covers into the button body 200*a*.

Figure 9:
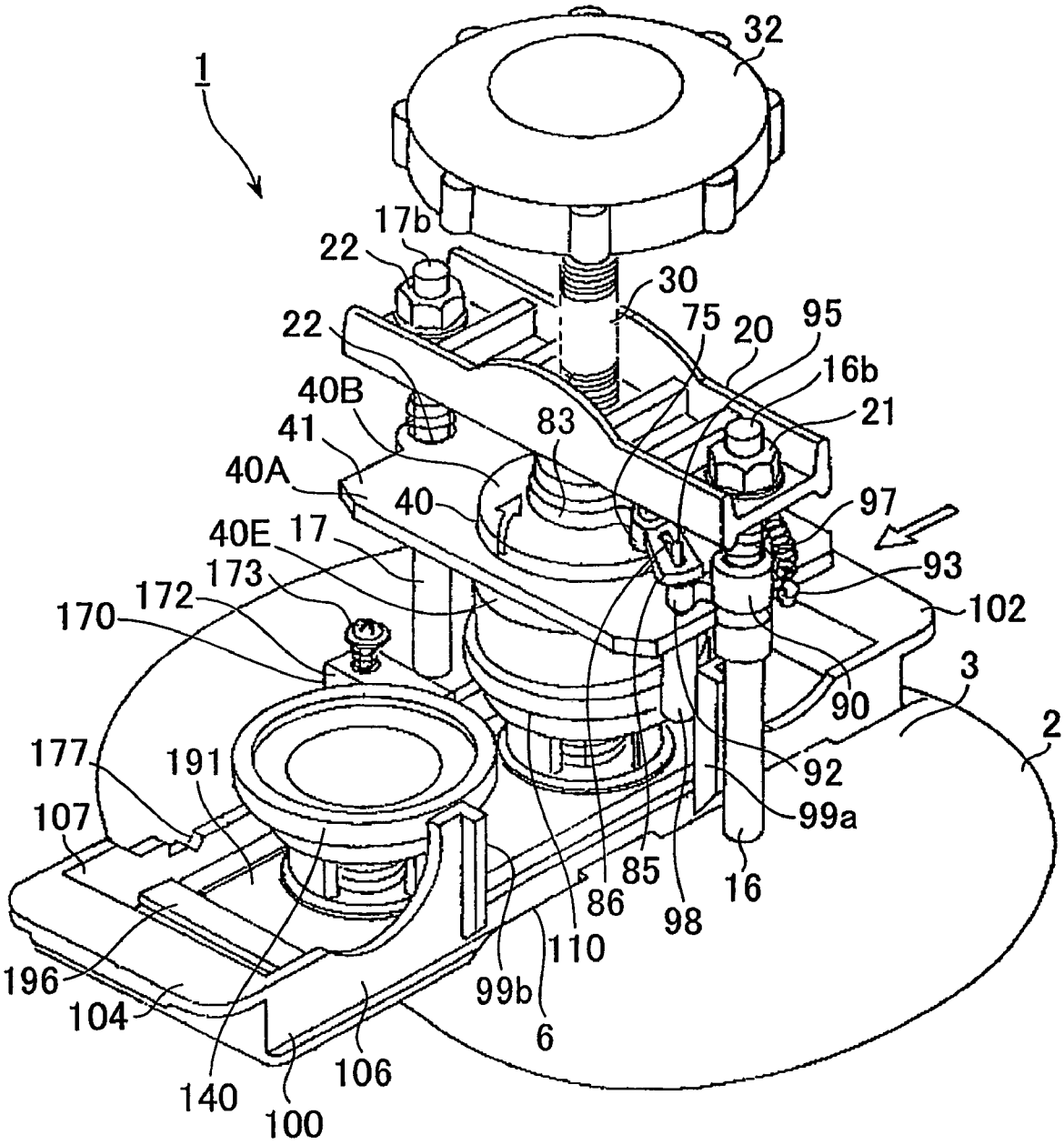
FIG. 9 is a perspective view showing the button manufacturing device with its cover removed.
Figure 10:
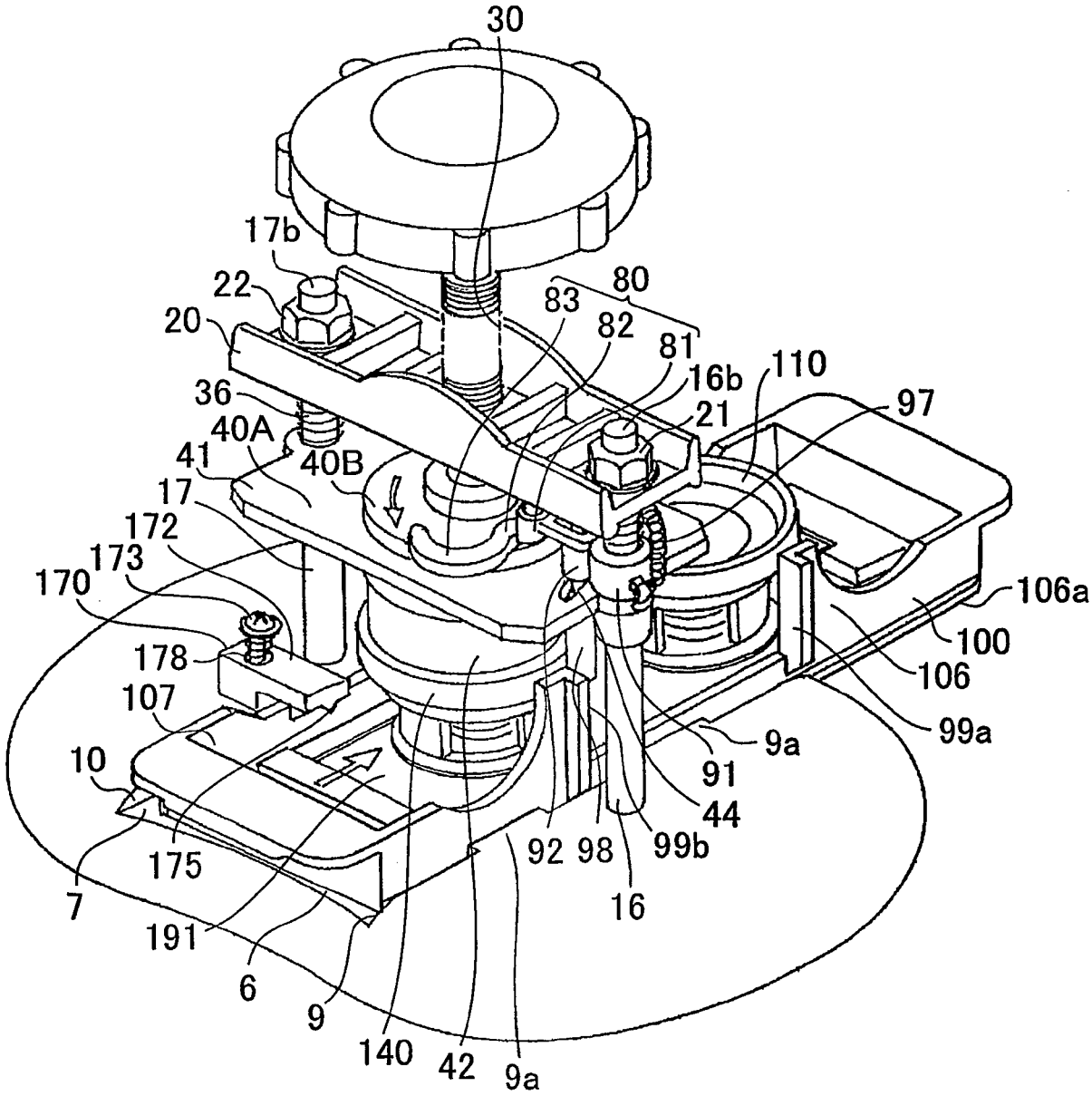
FIG. 10 is a perspective view showing the button manufacturing device having its phase altered from that in FIG. 9.

A design paper 211 printed with an insignia 215 such as a logotype, a pattern, a design or a combination of these is placed between the front plate 202 of the front cover 201 and the sheet member 213. A selection of the direction of the attachment means 229, 237, 246 transversing the rear plate 206 (for example, X direction, Y direction or Z direction,—refer to FIG. 9) is determined by a desired orientation of the insignia 213 when any of the attachment means 229, 237, 246 is applied to the item such as clothing to mount the button on the item such as clothing.

In addition to the button body 200*a* that has the insignia 215 such as a logotype, a pattern, a design or a combination of these and the selected one of two or more types of the attachment means 229, 237, 246 used to hold the button on the item such as clothing, a hat or a bag, the button 200 has any of the coupling members 220, 230, 240 that is used to secure the selected one of the attachment means to the button body 200*a*.

The attachment means may vary and may be a removable pin 229, a clip 237 or a magnet 246. The attachment means 229, 237, 246 are respectively secured to the rear plate 206 by means of a hole 207 formed in a substantially central part of the rear plate 206 and projection 221, 231, 241 fitted into the hole 207, respectively.

Figure 11:
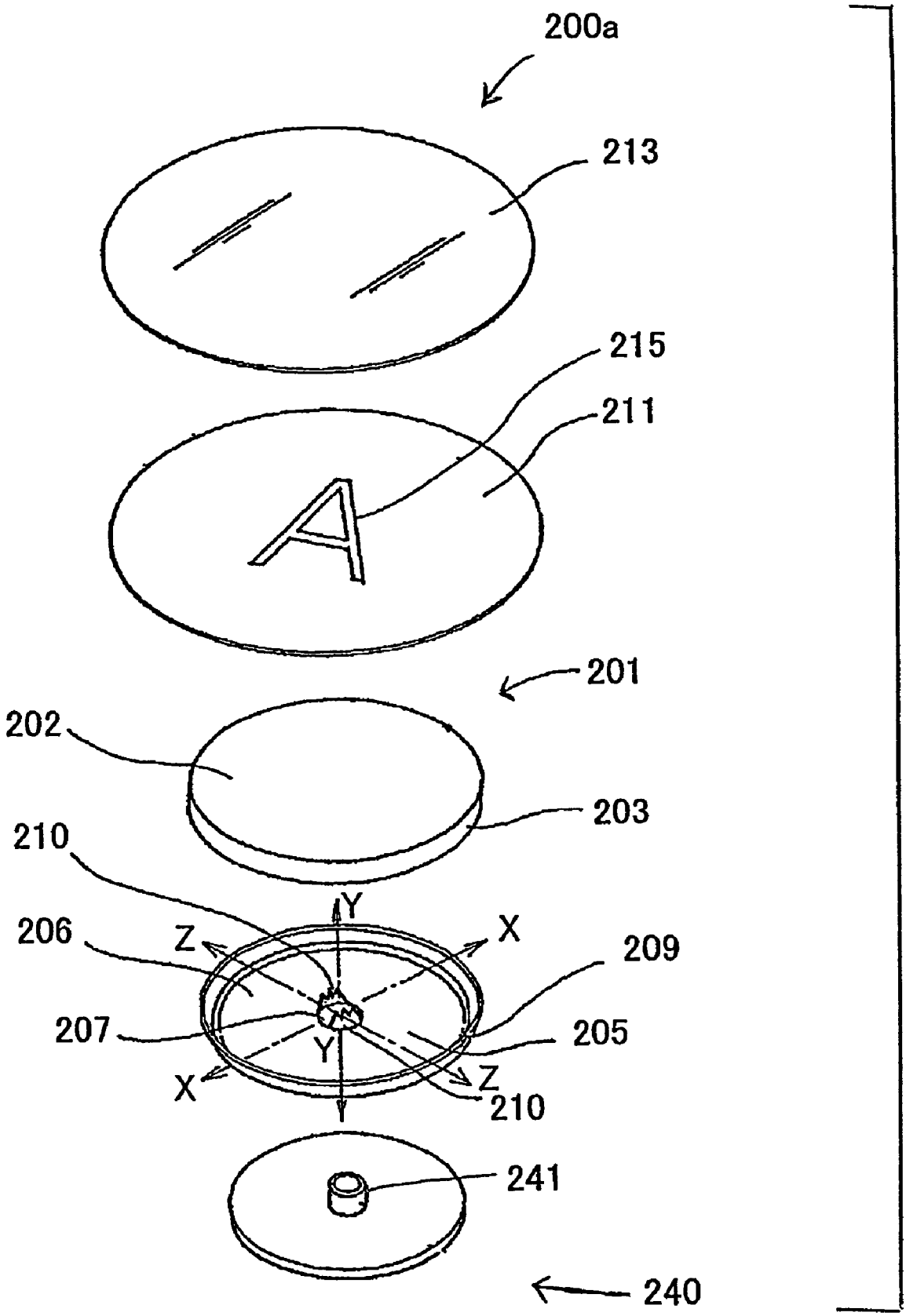
FIG. 11 is an exploded perspective view of a button according to the present invention.
Figure 12:
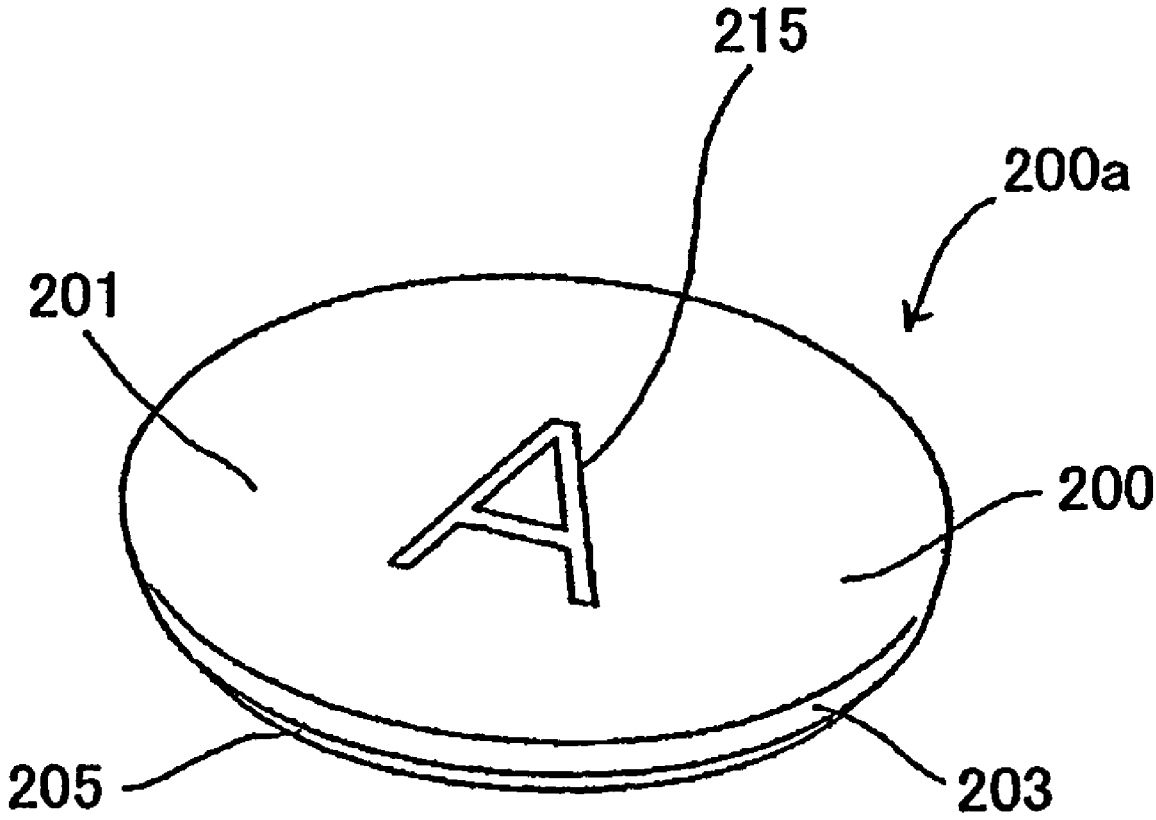
FIG. 12 is a perspective view of the button shown in FIG. 11 assembled.
Figure 13:
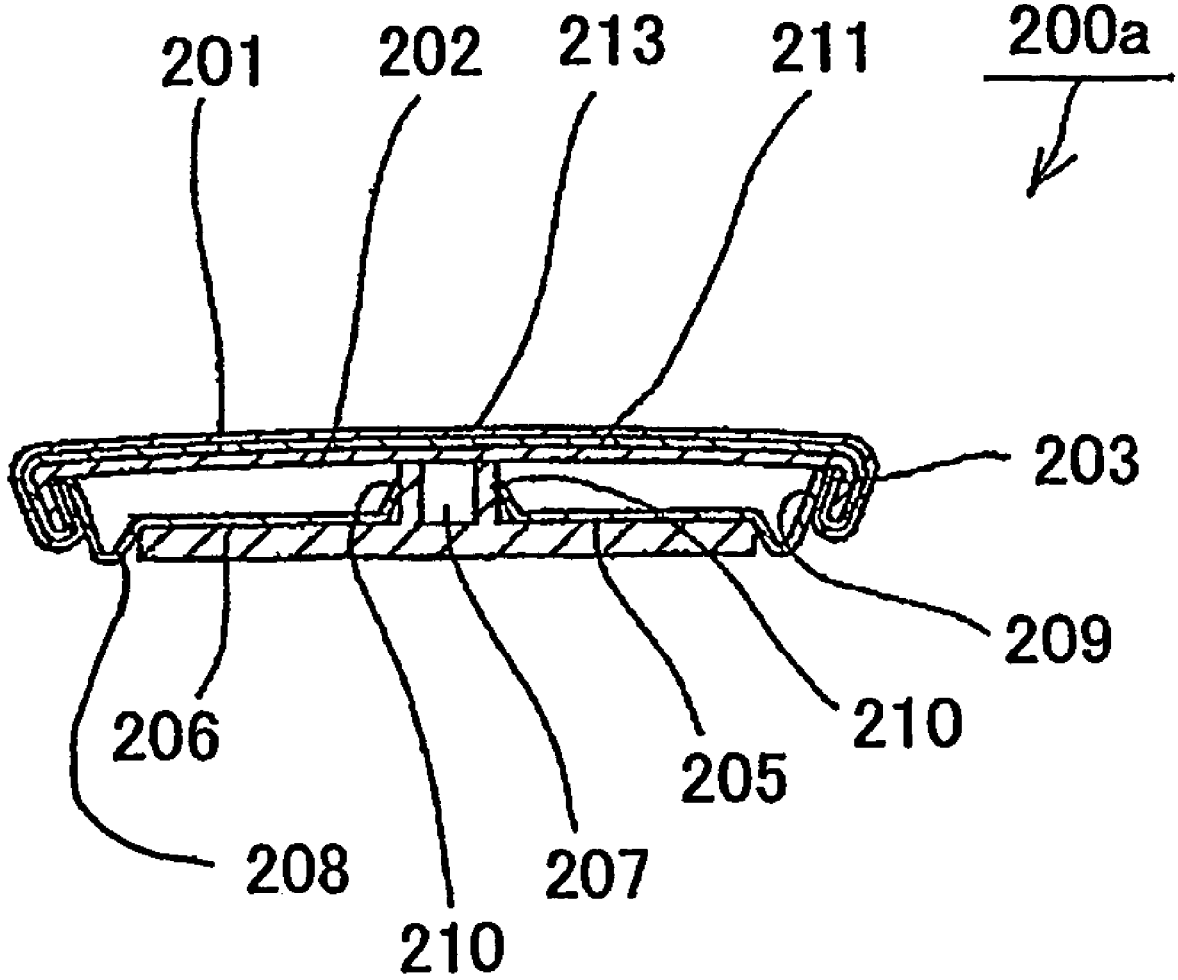
FIG. 13 is a side cross sectional view of the button body shown in FIG. 12.

The button will be described in more detail. The button 200 comprises the body 200*a*, the coupling member 220 and the removable pin (attachment means) 229, as shown in FIG. 11. The button body 200*a* is made up of the front cover 201, the rear cover 205, the design paper 211, and the cover body (sheet member) 213. The front cover 201 has a preformed curved front plate 202, and a front cover edge 203 bent at a substantially right angle extending downwards from the front plate 202. The rear cover 205 has a preformed rear plate 206 with the hole 207 formed substantially in the center, a rear cover edge 209 is bent almost at a right angle extending upwards from the rear plate 206, and a circular shaped concave portion 208 formed in the rear plate 206.

The design paper 211 is a circular paper sheet, on which is printed an insignia 215 that is a logotype, a pattern, a design or a combination of these, and it can even be a cutting from a magazine or the like. The cover body (sheet member) 213 is formed of a thin sheet of transparent synthetic resin. The button body 200*a* is made by overlapping the design paper 211 and the cover body (sheet member) 213 on an upper surface of the front cover 201, and bending the edge 203 of the front cover 201 so that the peripheries of the design paper 211 and the cover body (sheet member) 213 are gripped between the peripheral edge 203 of the front cover 201 and the peripheral edge 209 of the rear cover 205. It is also possible to print the insignia 215 that is a logotype, a design, a pattern or a combination of these directly on the cover body (sheet member) 213 without using the design paper 211. A pair of latch claws 210 protrude from the rim of the hole 207, diagonally opposing each other.

Figure 14:
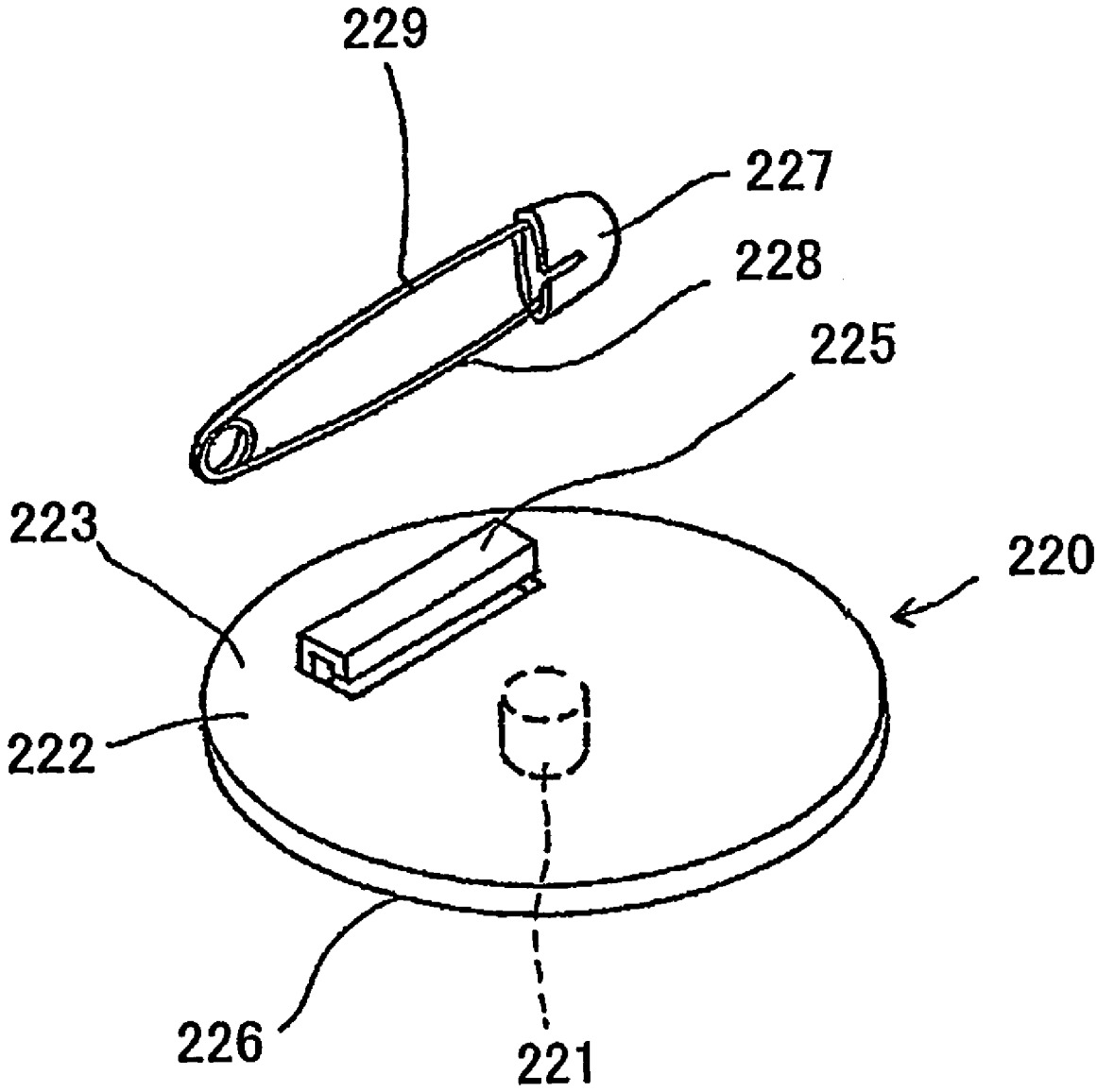
FIG. 14 is a perspective view showing an exemplary attachment means for the button of the present invention.
Figure 15:
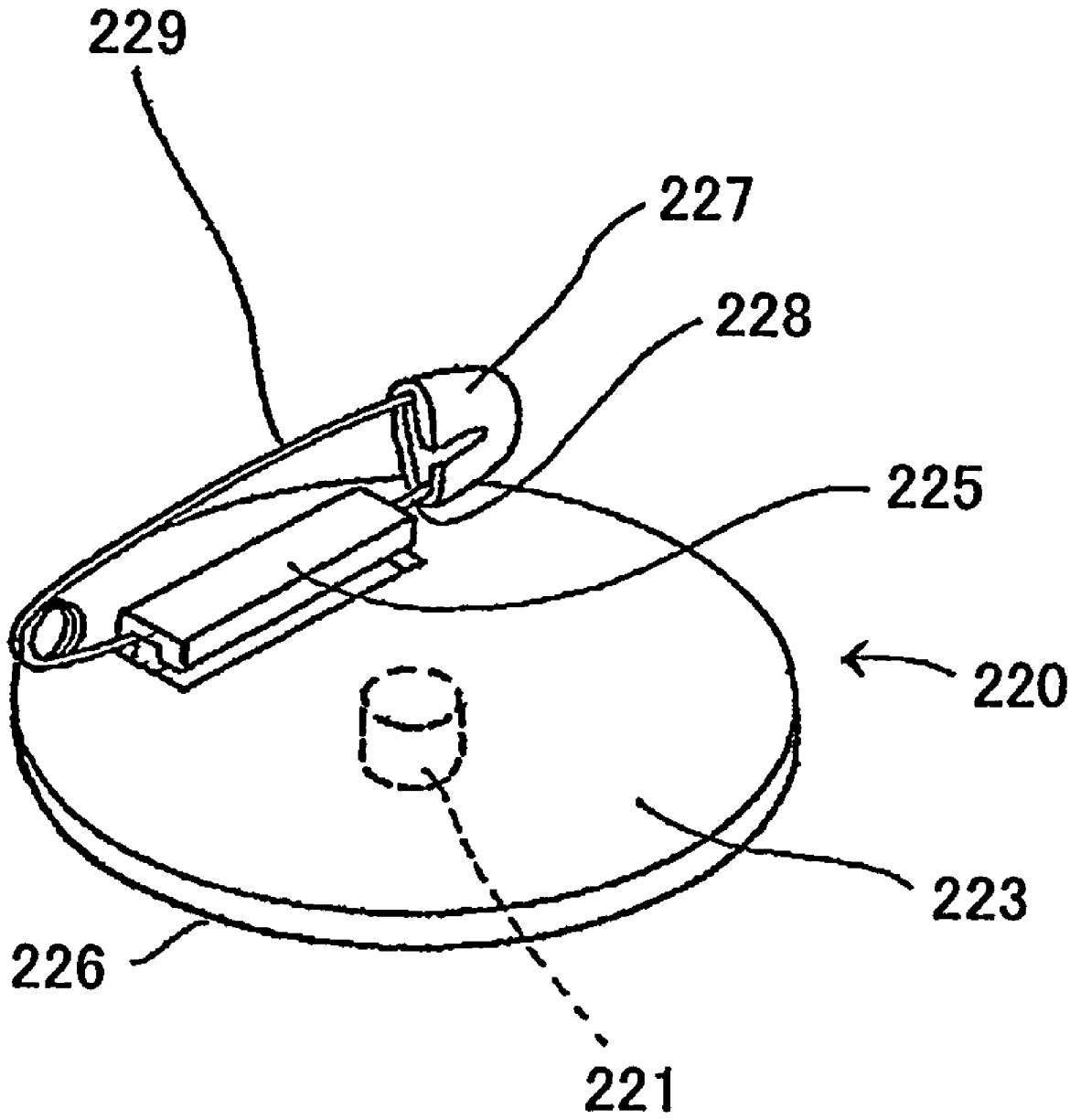
FIG. 15 is a perspective view showing the attachment means shown in FIG. 14 being applied.
Figure 16:
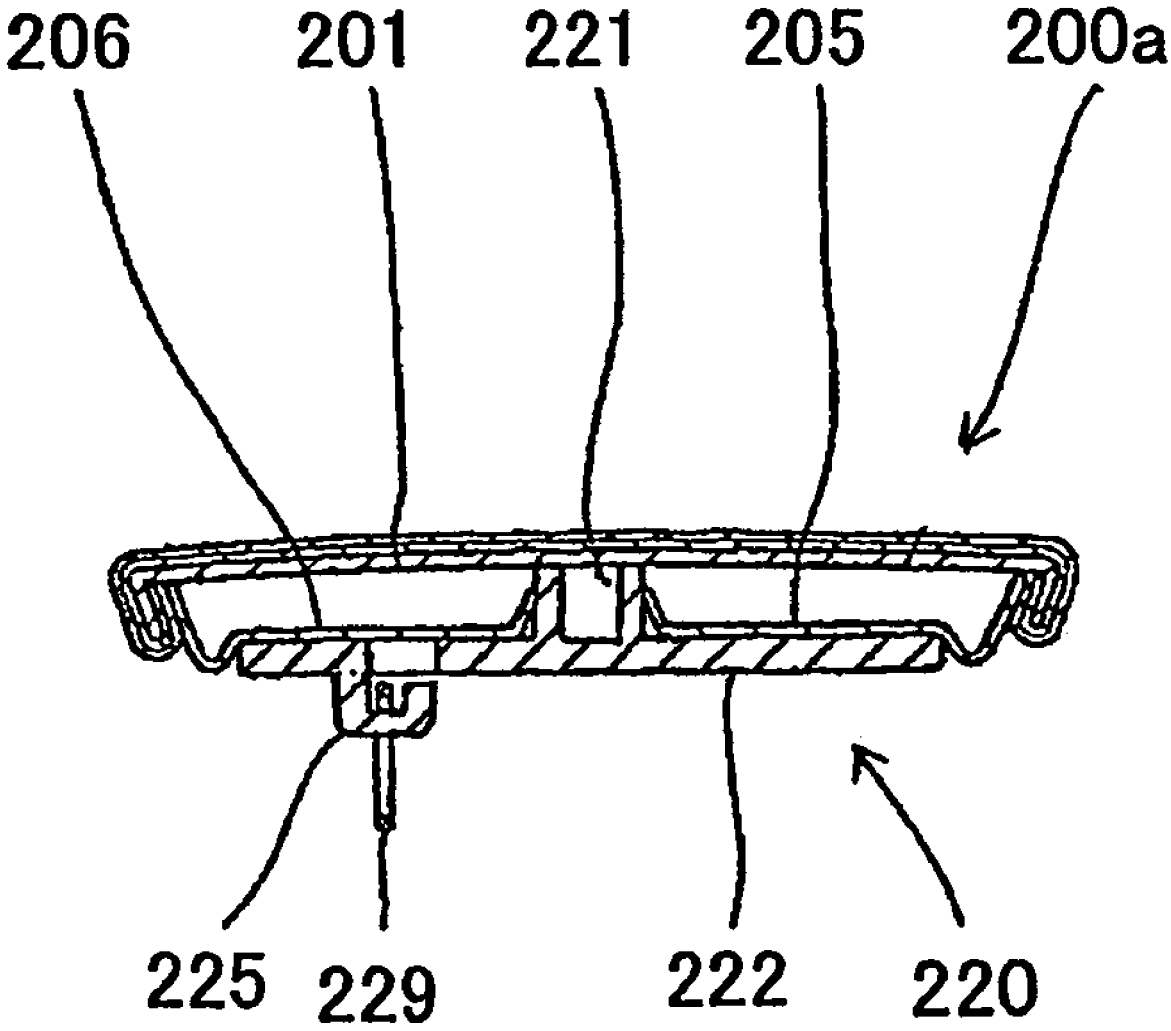
FIG. 16 is a side cross sectional view of the whole button, showing the attachment means of FIG. 15 operatively connected to a rear cover.

As shown in FIG. 14 to FIG. 16, the coupling member 220 comprises a base plate 222, a substantially L-shaped hook 225 formed on the surface 223 of the base plate 222, and a projection 221 protruding at a substantially central part of the rear surface 226 of the base plate 222. In use it is associated with the hole 207 formed in a substantially central part of the rear cover 205. The base plate 222, the hook 225 and the projection 221 are integrally formed of synthetic resin, and are separate from the button body 200*a* described above. The base plate 222 is secured to a detachable pin (attachment means) 229 by means of a hook 225, and the projection 221 is fitted into the hole 207 of the rear cover 205 so that the base plate 222 is fitted in the concave 208 of the rear cover 205.

In this way, the button body 200*a* and the detachable pin (attachment means) 229 are linked using the coupling member 220. The detachable pin (attachment means) 229 is secured in a transverse position on the rear plate 206 (e.g., in the X direction Y direction or Z direction in FIG. 11). The projection 221 is inserted into the hole 207 while confirming the orientation of the insignia 215 on the button body 200*a* as desired, so as to secure the detachable pin (attachment means) 229 to the button, and thus, it is possible to select the attachment direction (e.g., in the X direction, Y direction, or Z direction in FIG. 11) of the detachable pin (attachment means) 229.

When the projection 221 is fitted into the hole 207, it is onto the latch claws 210 on the rim of the attachment hole 207. Although the detachable pin (attachment means) 229 is capable of rotating relative to the button body 200*a*, excessive pivotal movement causes abrasion of the projection 221 by the latch claws 210, which may cause the pin to come off from the button body 200*a*, and the rotation should be limited to only fine adjustment.

Figure 17:
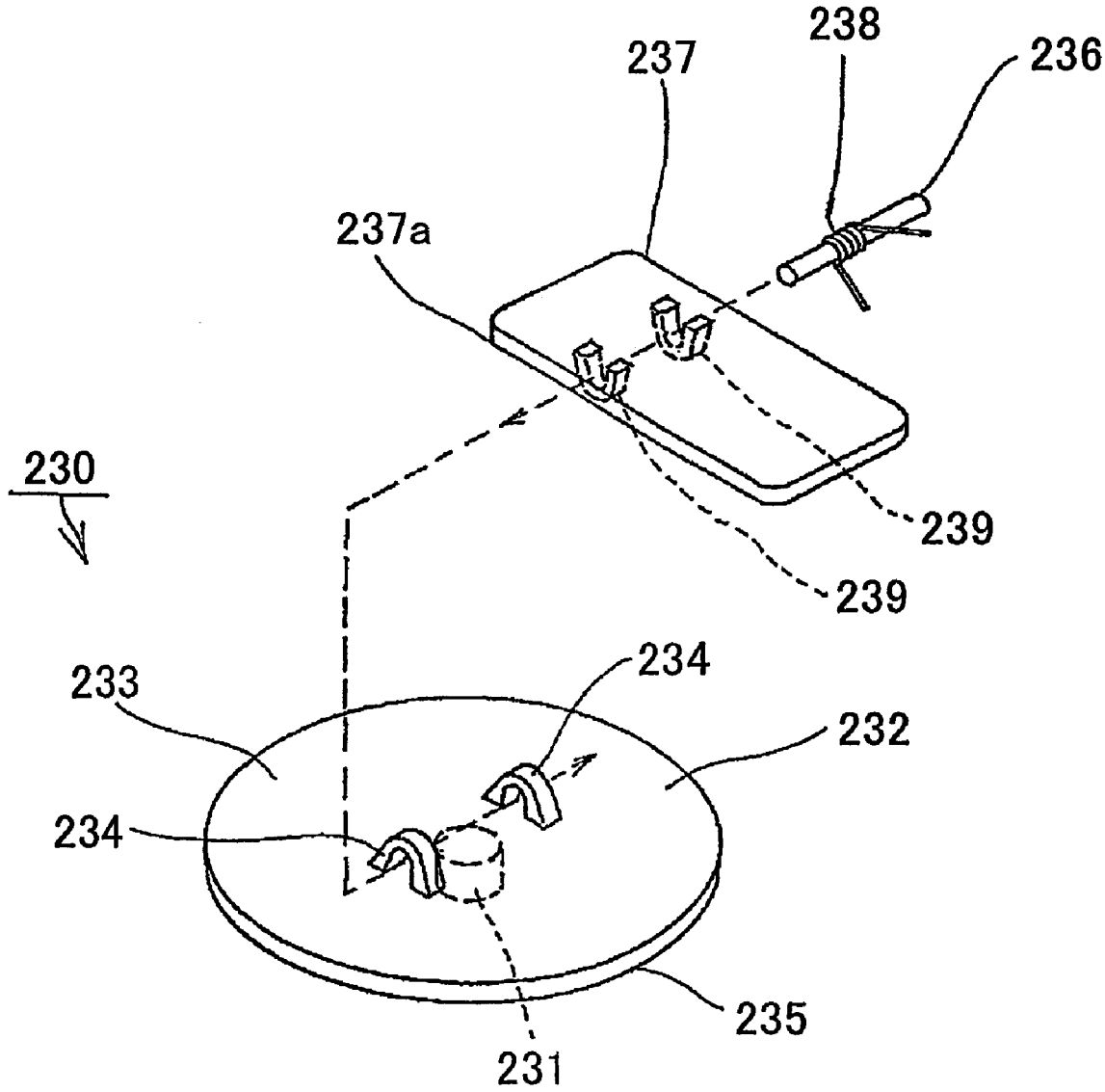
FIG. 17 is a perspective view showing another exemplary attachment means for the button of the present invention.
Figure 18:
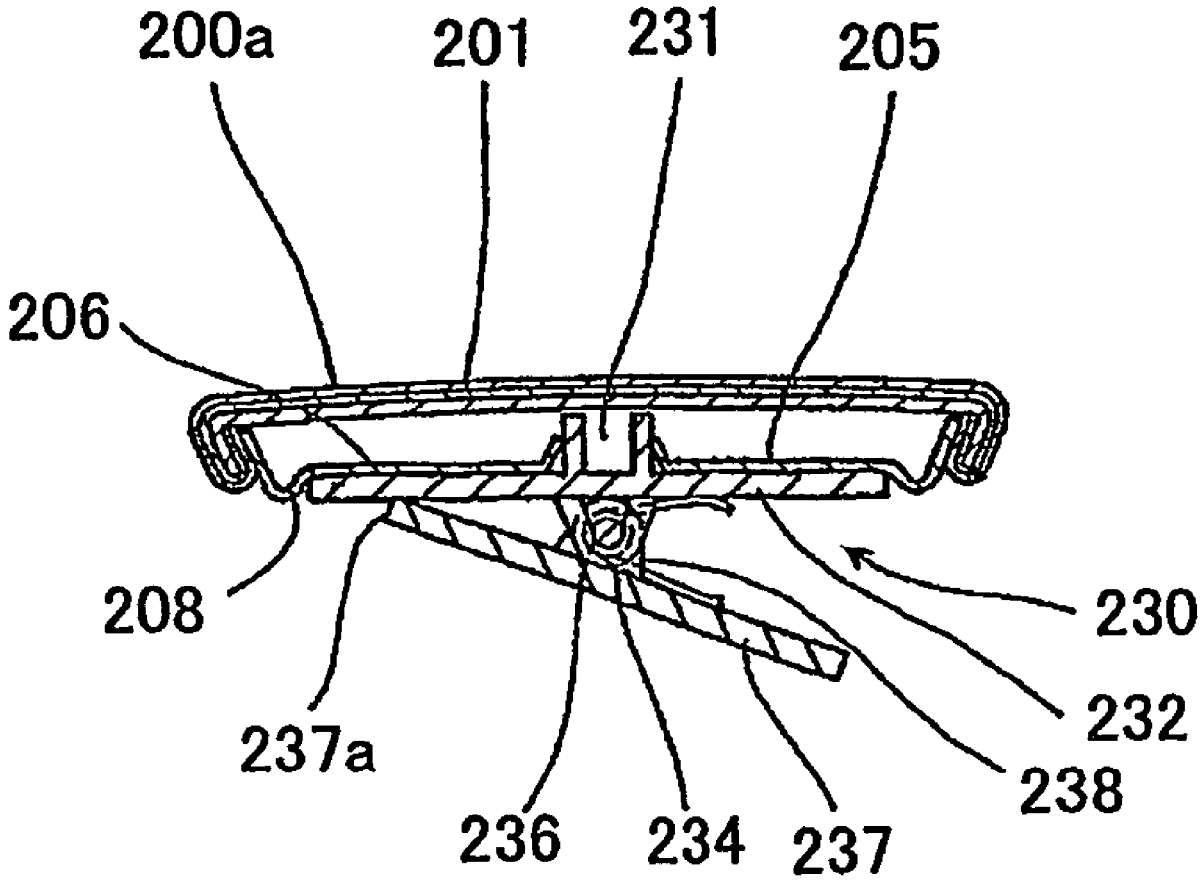
FIG. 18 is a side cross sectional view of a whole button, showing the attachment means of FIG. 15 operatively connected to the rear cover.

As shown in FIG. 17 and FIG. 18, the coupling member 230 is preferably comprised of a base plate 232, a pair of substantially U-shaped bearing lugs 234 formed substantially in the center of one side 233 of the base plate 232, a projection 231 protruding substantially at the center of the other side 235, and an associated hole 207 formed substantially at the center of the rear cover 205, and the base plate 232 having the projection on the rear side 235 has the opposite side leaned by one end 237*a* of a clip plate 237 which is pivotal about a shaft 236 held by the pair of the bearing lugs 234 by virtue of an elastic element 238 such as spring. In this case also, the base plate 232 and the raised element 231 are integrally formed of synthetic resin, and is separate from the button body 200*a*. The clip plate 237 gives a pinch along with the base plate 232 against which the end 237*a* is pressed by an elastic member 238.

The raised element 231 is inserted into the hole 207 of the rear cover 205 so that the base plate 232 is fitted in the concave 208 of the rear cover 205. In this way, the button body 200*a* and the clip-shaped attachment means of the clip plate 237 and the base plate 232 are linked together, using the coupling member 230. The clip plate (attachment means) 237 extends in a transverse direction across the rear plate 206 (e.g., in the X direction, Y direction or Z direction of FIG. 11). The projection 231 is inserted into the hole 207 while confirming the orientation of the insignia 215 on the button body 200*a* as desired, so as to secure the clip plate (attachment means) 237 to the button, and thus, it is possible to select the attachment direction (e.g., the X direction, Y direction or Z direction in FIG. 11) of the clip plate (attachment means) 237.

When the projection 231 is fitted into the hole 207, it is onto the latch claws 210 formed on the rim of the hole 207. The clip plate (attachment means) 237 is capable of rotating relative to the button body 200*a*, but excessive pivotal movement causes abrasion of the projection 231 by the latch claws 210, which may cause the clip plate 237 to come off from the button body 200*a*, and the rotation should be limited to only fine adjustment.

Figure 19:
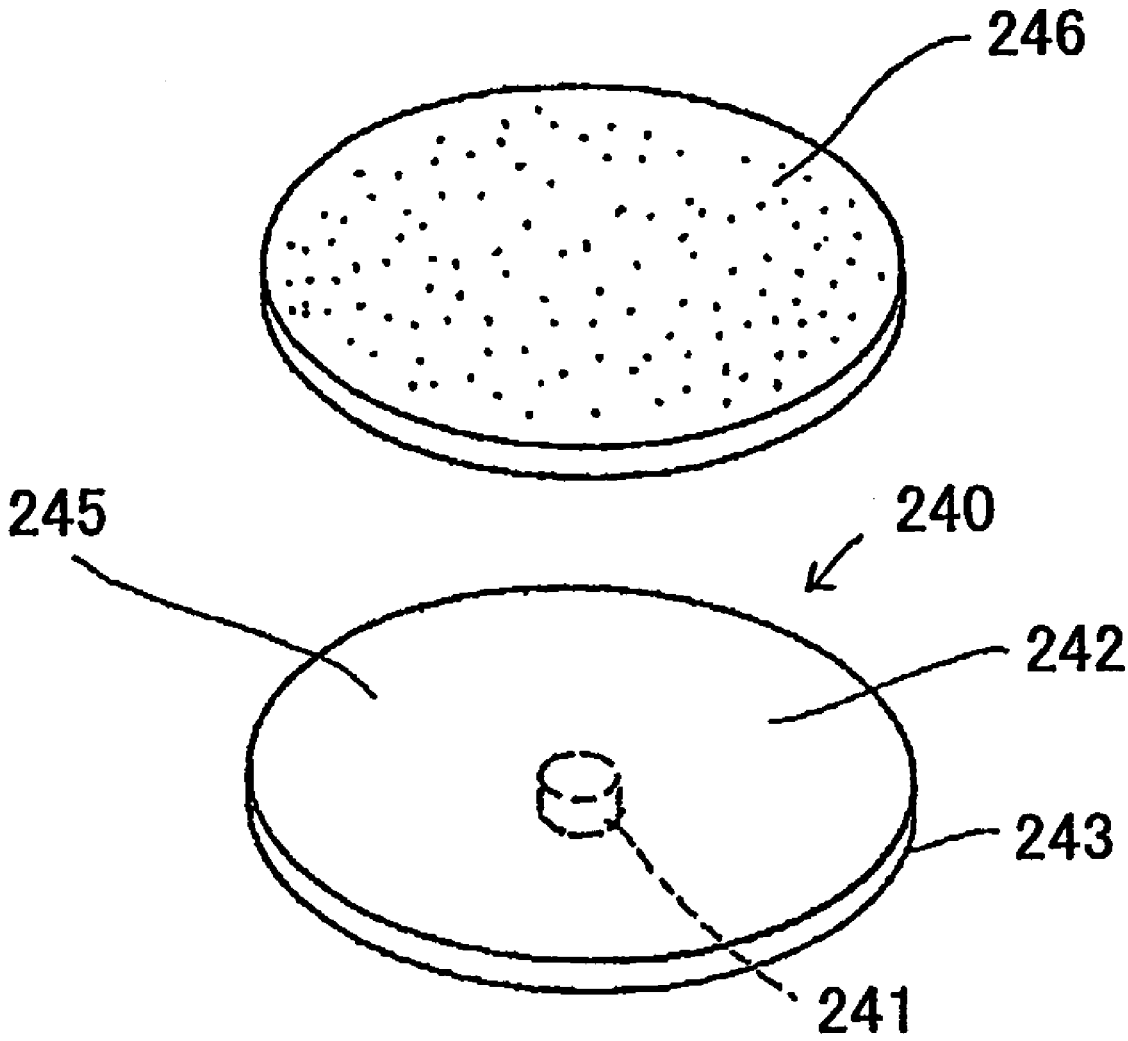
FIG. 19 is a perspective view showing another exemplary attachment means according to the present invention.
Figure 20:
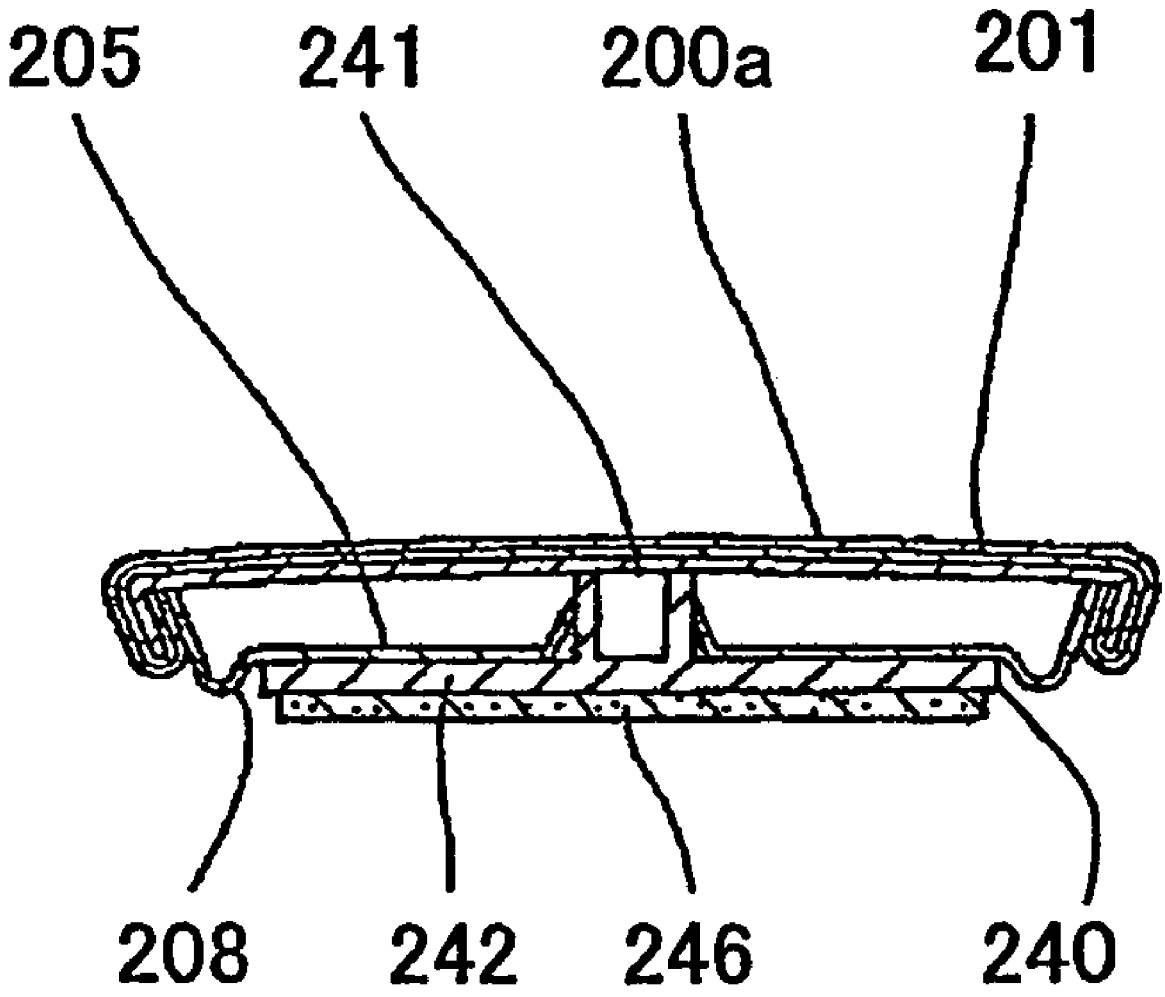
FIG. 20 is a side cross sectional view of a whole button, showing the attachment means of FIG. 17 operatively connected to the rear cover.
Figure 21:
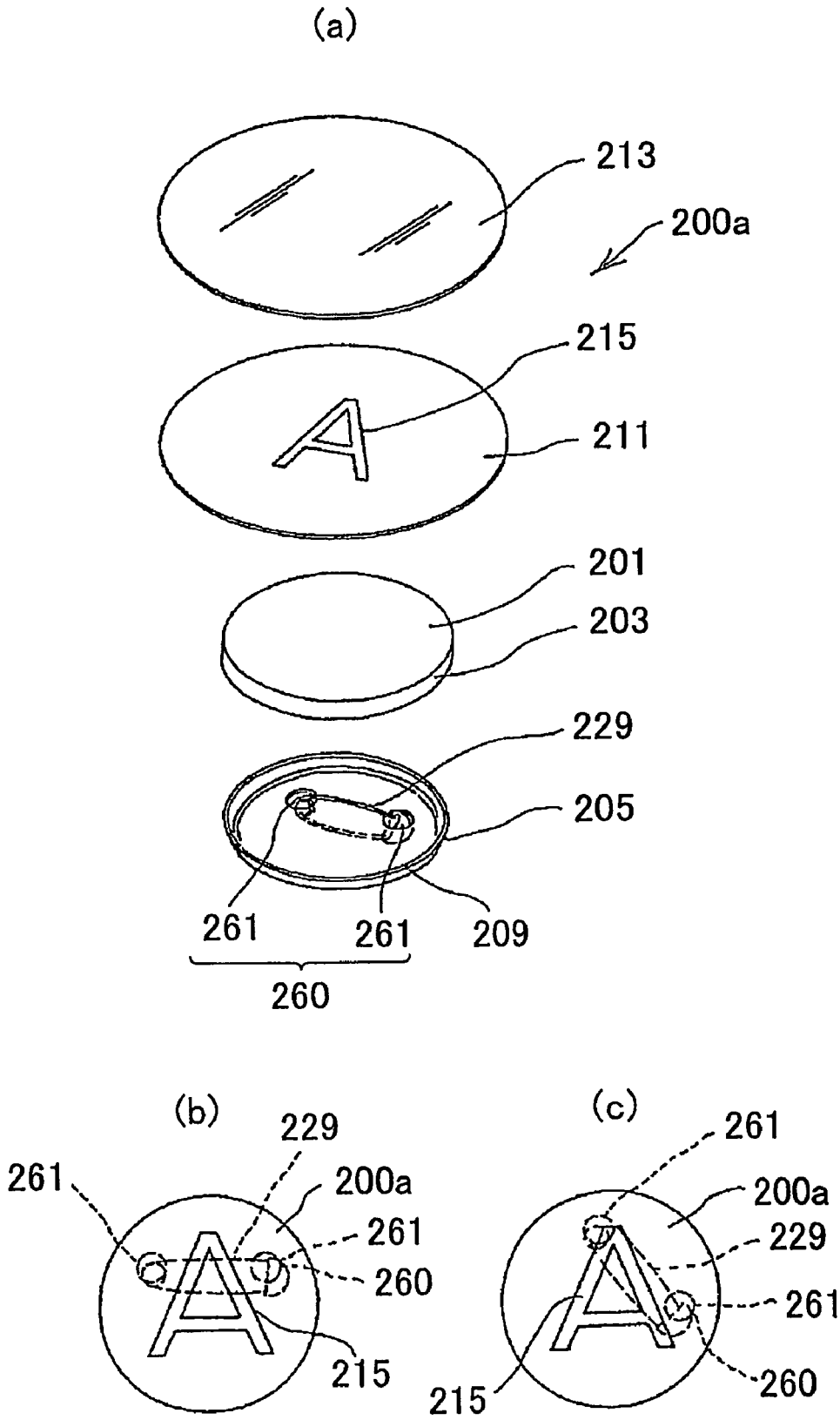
FIG. 21 is a diagram illustrating a button of the related art.

As shown in FIG. 19 and FIG. 20, the coupling member 240 may alternatively be comprised of a base plate 242, a projection 241 protruding substantially at the center of a rear side 243 of the base plate 242, and an associated hole 207 formed substantially at the center of the rear cover 205, and the base plate 242 having the raised element on the rear side 243 has the reverse side 245 bonded to a magnetic disk 246 by adhesive. In this case also, the base plate 242 and the raised element 241 are integrally formed of synthetic resin, and are separate from the button body 200*a*.

The projection 241 is inserted into the hole 207 of the rear cover 205 so that the base plate 242 is fitted in the concave 208 of the rear cover 205.

In this way, the button body 200*a* and the magnetic disk (attachment means) 246 are linked together, using the coupling member 240. If the raised element 241 is fitted into the hole 207, it is onto the latch claws 210 formed on the rim of the hole 207. In this manner, the button 200 can be assembled by securing selected one of two or more types of attachment means such as the detachable pin 229, the clip 237 or the magnetic disk 246 to the button body 200*a*, using the coupling member 220, 230 or 240 thereon.

Next, one embodiment of a button manufacturing device for fabricating the button of the present invention will be described with reference to FIG. 1 to FIG. 8. The button manufacturing device 1 is especially used to produce a button which is comprised of a rear cover 205 with the periphery 209 extending upward, a front cover 201 with the periphery 203 extending downward, and a design paper 211 and a transparent cover (sheet) 213 placed on top of the front cover 201. The front cover 201 has its periphery buckled while the design paper 211 and the transparent sheet 213 have their respective peripheries gripped between the peripheries 203 and 205 of the front and rear covers 201 and 205.

The device 1 comprises a base 2, a slide platform 100 capable of reciprocally moving on an upper surface of the base 2, first and second lower dies 110 and 140 spaced from each other along the trajectory of the reciprocal movement of the slide platform 100, a beam 20 fixed to upper portions of struts 16 and 17 above the slide platform 2, a press screw shaft 30 fitted into the beam 20 threaded in a female screw 17*b* to screw up and down therethrough, an upper die 40 located at a lower end of the press screw shaft 30 and pressed onto the first and second lower dies 110 and 140, and an operating handle 32 provided on an upper part of the press screw shaft 30.

The first lower die 110 comprises a first table 111 where the front cover 201 is to be put, and a guide table 125 surrounding the first table 111 for carrying the design paper 211 and transparent sheet 213 laid one over another, and the guide table 125 is urged upward by an elastic member 113 to move up and down.

The second lower die 140 comprises a second table 141 where the rear cover 205 is placed, and a processing platform 155 located around the second table 141 for bending the peripheral edge 203 of the front cover 201 onto the peripheral edge 203 of the rear cover 205 so that both the design paper 211 and the transparent sheet 213 have their respective peripheries gripped by those edges 203 and 209 of the front and rear covers 201 and 209. The processing platform 155 is urged upward by an elastic member 156 to move up and down.

The upper die 40 comprises an outer frame 42, and a shallower inner frame 51 located inside the outer frame 42, the inner frame being rotatable at a lower end of the press screw shaft 30 passing an opening 43 at an upper end of the outer frame.

The upper die 40 further comprises a switch member 80 serving to switch to either the outer or inner frame, 42 or 51, pressed by the press screw shaft 30, depending upon a position of the first or second lower die 110 or 140. When the first lower die 110 is almost right below the upper die 40, the switch member 80 latches onto the upper end of the outer frame 42 and is pressed by the press screw shaft 30, or otherwise, when the second lower die 140 moves on the slide table 100 to reach almost right below the upper die 40, the switch member 80 leaves the upper end of the outer frame 42 and is not pressed by the press screw shaft 30.

In this button manufacturing device 1, an operating handle 32 is rotated to lower the press screw shaft 30. The pressing force against the switch member 80 causes the outer frame 42 to move down and bump against the guide table 125 around the first lower die 110, which pushes the guide table 125 down against repelling force of the elastic member 113 until the print paper 211 and the transparent sheet 213 are bent over the peripheral edge 203 of the front cover 201. On the contrary, when the switch member 80 is dislocated from the press contact with the screw shaft 30, the inner frame 51 is forced downward to bump against the processing platform 155 around the second lower die 140, which pushes the processing platform 155 down against elasticity of an elastic member 156 until the peripheral edge 203 of the front cover 201 is buckled onto the peripheral edge 209 of the rear cover 205 so that the print paper 211 and the transparent sheet 213 have their respective peripheries gripped between the contact edges 203 and 209 of the front and rear covers 201 and 205.

The button manufacturing device 1 will now be described in greater detail. The base 2 is integrally formed of synthetic resin and comprises an upper wall 3 and a curved peripheral wall 5 contiguous to the upper wall 3, and a substantially U-shaped guide groove 6 extending in a front to rear direction is formed on the upper wall 3. The guide groove 6 is defined by a bottom wall 7 and side walls 9 and 10, with guide protuberances 9*a* and 10*a* being formed on upper parts of the side walls 9 and 10.

Also, bosses 11 and 12 reaching a level of the bottom wall 7 of the guide groove 6 are formed at a substantially central part of the upper wall 3 of the base 2, on either side of the guide groove 6, extending orthogonal to the guide groove 6 (in a lateral direction). Through holes 11*a* and 12*a* extending to the upper wall 3 are formed in the bosses 11 and 12.

A reinforcing member 15 having a substantially U-shaped cross section is formed in the bottom wall 7 of the guide groove 6 of the base 2 in a direction orthogonal to the guide groove 6 (lateral direction). This reinforcement member 15 is made of steel material. The reinforcement member 15 contacts the bosses 11 and 12, and holes 15*a* and 15*b* are formed, registered with the through holes 11*a* and 12*a* of the bosses 11 and 12, respectively. Struts 16 and 17 having a substantially circular cross section are erected on the base 2. The struts 16 and 17 are made of steel material.

One strut 16 has its lower part threaded in a male screw 16*a* which is inserted into the through hole 11*a* of the boss 11 and the hole 15*a* of the reinforcement member 15 and is fastened using a nut 18, to be fixed substantially perpendicular to the boss 11 and the reinforcement member 15. The other strut 17 has its lower portion threaded in a male screw 17*a* which is inserted into the through hole 12*a* of the boss 12 and the hole 15*b* of the reinforcement member 15 and is fastened using a nut 19, to be fixed substantially perpendicular to the boss 12 and the reinforcement member 15.

The beam 20 having a substantially square cross section is fixed to the struts 16 and 17 horizontally above the base 2. One strut 16 has its upper part machined into male screw 16*b* and inserted into a hole 20*a* formed in one end of the beam 20 and is fastened using a nut 21, so as to ensure secureness of the beam 20. The other strut 17 has its upper part machined into the male screw 17*b* and inserted into a hole 20*b* formed in the other end of the beam 20 and is fastened using a nut 22, so as to further ensure secureness of the beam 20.

The beam 20 has a through hole 23 formed substantially at the center, and a female screw element 25 is fixedly attached substantially coaxially with this through hole 23. It is also possible to directly machine the part defining the through hole 23 to make the female screw 25. The press screw shaft 30 goes through the through hole 23 and screwed into the female screw section formed in this beam 20, so as to be capable of moving in the axial directions. The press screw shaft 30 is made in the unit of durable and abrasion-proof hard synthetic resin such as polycarbonate. An attachment section 31 is formed on an upper part of the press screw shaft 30, and the operating handle 32 is fixedly attached to this attachment section 31 using a screw 33.

The upper die 40 mating with the first lower die or the second lower die as described later is provided on a lower end of the press screw shaft 30. The upper die 40 comprises a vertical sliding member 41 formed in a substantially diamond shape, an outer frame 42, and a shallower inner frame 51 located inside the outer frame 42. The outer frame 42 comprises a U-shaped outer curved section 45 with its open end face down, an outer neck section 46 formed on an upper part of the outer curved section 45, a peripheral wall 47 formed on a lower peripheral edge of the outer curved section 45, and a pressing section 50 formed on a lower end of the peripheral wall 47, with a guide hole 49 being formed in the outer neck section 46 and this guide hole 49 connecting with an opening 43 formed on an upper end 48 of the outer neck section 46.

The inner frame 51 comprises an inner curved section 52 engaging with the outer curved section 45 of the outer frame 42, a contact edge 53 formed at a lower edge of the inner curved section 52 and contacting the peripheral edge 203 of the button front cover 201, described later, an inner neck section 55 formed at an upper part of the inner curved section 52, slidably guided into the guide hole 49 of the outer neck section 46 and having an upper end 58 that is positioned at substantially the same as the upper end 48 of the outer neck section 46 if the inner curved section 52 engages with the outer curved section 45, a protuberance 57 formed substantially in the center of the upper end 58 of the upper wall 56 of the inner neck section 55, and a through hole 59 formed substantially centrally in the upper wall of the inner neck section 55 and stretching to an upper end 60 of the protuberance 57.

The press screw shaft 30 has a spindle 35 formed centrally at a lower end, and a screw hole 36 is formed in a lower end of this spindle 35. A pressing member 61 is provided on a lower part of the press screw shaft 30. The pressing member 61 comprises a bottom wall 62, a peripheral wall 63 provided around the bottom wall 62, and an annular flange section 65 provided on an upper part of the peripheral wall 63, and a through hole 66 is formed in the center of the bottom wall 62, and the spindle 35 is passed through the through hole 66 and rotatably attached to the press screw shaft 30 so as to cover the lower part of the press screw shaft 30.

Further, the inner frame 51 is rotatably provided on the lower end of the press screw shaft 30 by inserting the spindle 35 of the press screw shaft 30 into the through hole 59 of the inner frame 51 and turning a screw 69 into the screw hole 36 of the spindle 35. The pressing member 61 is formed with the peripheral wall 63 having substantially the same outer diameter as the inner neck section 55 of the inner frame 51, so that the pressing member 61 enters the guide hole 49 from the opening 43 formed in the upper part of the outer frame 42. Accordingly, the inner frame 51 is rotatably provided on the lower end of the press screw shaft 30 passing the opening 43 in the upper part of the outer frame 42.

The vertical sliding member 41 is formed in a plate shape and has guide indents 71 and 72 at the left and right ends which receive the struts 16 and 17, and is guided so as to only be able to move up and down by these indents 71 and 72. An indication plate 73 for enabling confirmation of the positions of these indents is integrally formed on a right end of the vertical sliding member 41. A switch member 80 is provided on the upper die 40 and serves to switch from the outer frame 42 to the inner frame 51 that is to be pressed by the press screw shaft 30 or vice versa, depending upon the first lower die or the second lower die right below the screw shaft.

A bearing section 75 is formed in the outer frame 42 of the upper die 40 (or the vertical sliding member 41), and the switch member 80 is rotatably attached to this bearing section 75 via a screw 76. The switch member 80 comprises a boss section 81 rotatably attached to the bearing section 75 using the screw 76, a first arm section 82 provided on the boss section 81, a semi-ring shaped engagement section 83 provided on the first arm section 82 to engage with the protuberance 57 of the inner frame 51, and a second arm section 85 provided at a position of the boss section 81 substantially opposite to the first arm section 82, and an elongated hole shaped engagement groove 86 is formed in the second arm member 85.

A rocking member 90, which is located in the strut 16, is capable of swinging and moving up and down along with the upper die 40. The rocking member 90 is made up of a boss section 91 attached to the strut 16, an arm section 92 provided on one side of the boss section 91, and a spring receiving hook 93 provided on the other side of the boss section 91. An engagement shaft 95 is formed substantially vertically on the arm section 92. The engagement shaft 95 has an upper section 95*a* fitted in the engagement groove 86 of the switch member 80, and a lower section 95*b* projecting from the elongated hole 44 formed in the vertical sliding member 41.

A spring receiving hook 96 is provided on a rear section of the vertical sliding member 41. A spring 97 is placed between this spring receiving hook 96 and the spring receiving hook 93 of the rocking member 90. The engagement section 83 of the switch member 80 is brought into contact with a protuberance 57 of the inner frame 51 via the rocking member 90 under resilience of this spring 97.

The slide platform 100 is provided in the guide groove 6 of the base 2 so as to be reciprocally movable. The slide platform 100 is guided to only move in the forward and backward directions by guide projections 9*a* and 10*a* formed in the side walls 9 and 10 of the guide groove 6. A front wall 101 is provided on a front end of the slide platform 100, and a tab 102 is provided on the front wall 101. A rear wall 103 is provided on a rear end of the slide platform 100, and a tab 104 is provided on the rear wall 103.

The first and second lower dies 110 and 140 are opposed to each other along the trajectory of the reciprocal movement of the slide platform 100. The first lower die 110 is made up of a first table 111 where the front cover 201 is to be put on, and a guide table 125 surrounding the first table 111 for carrying the design paper 211 and the cover (sheet) 213 laid one over another. The guide table 125 is capable of moving up and down while being urged upwards by the elastic member 113. The first table 111 comprises a slightly curved upper wall 115, a peripheral wall 116 formed on a lower peripheral edge of the upper wall 115, and a cylindrical shaft 117 fixed substantially in the center of a lower surface of the upper wall 115.

The first table 111 has a lower part of the peripheral wall 116 engaged with an annular guide protuberance 118 provided on the slide platform 100, and a lower end of the shaft 117 fitted in a concave section 120 of the boss section 119 formed on the slide platform 100, and it is fixed to the slide platform 100 by passing a screw 122 from the reverse side of the slide platform 100 through a hole formed therein and screwing it into the fixed shaft 117.

The guide table 125 is annular in shape, and has a ring-shaped mount section 126 carrying the design paper 211 and the cover (sheet) 213 laid one over another, and a guide wall 127 contiguously surrounding the mount section 126 for guiding peripheral edges of the design paper 211 and the cover (sheet) 213. The pressing section 50 of the outer frame 42 engages with the guide wall 127 of the guide table 125, and the pressing section 50 is pressed down onto the mount section 126. A cylinder 129 slides up and down along the peripheral wall 116 of the first table 111 and extends downward from and inside the mount section 126.

The guide table 125 also has a guide cylinder 132 vertically moving inside the peripheral wall 116 of the first mount table 111. The guide cylinder 132 has a boss section 131 having a guide hole 130 through which the fixed shaft 117 of the first mount table 111 slides. The guide cylinder 132 and the cylinder 129 have their respective lower ends connected together by a linking lug 133. This linking lug 133 is fitted in a long groove 135 cut into a vertical slot in the peripheral wall 116 of the first mount table 111.

The upper wall 115 of the first mount table 111 and the mount section 126 of the guide table 125 are of roughly the same height, and the upper wall 115 and the mount section 126 are spaced apart to make a gap 136 through which the curved peripheral edge 203 of the front cover 201 is inserted. The guide table 125 is urged upwards by the spring (elastic member) 113 wound around the shaft 117 of the first mount table 111.

The second lower die 140 comprises the second table 141 where the rear cover 205 is placed, and the processing platform 155 surrounding the second table 141. The processing table, capable of moving up and down while being urged by the elastic member 156, is used to buckle the peripheral edge 203 of the front cover 201 onto the peripheral edge 209 of the rear cover 205 so that the design paper 211 and the cover (sheet) 213 have their respective peripheries gripped together between the contact edges 203 and 209 of the front cover 201 and the rear cover 205. The second table 141 is made up of an upper wall 143 formed with a circular indent 142, a peripheral wall 145 formed at a lower peripheral edge of the upper wall 143, and a cylindrical shaft 146 fixed substantially at the center of a lower surface of the upper wall 143.

The second table 141 has a lower part of the peripheral wall 145 engaged with an annular guide protuberance 148 provided on the slide platform 100, a lower end of the shaft 146 fitted in a concave section 150 of the boss section 149 formed on the slide platform 100, and is fixed to the slide platform 100 by passing a screw 152 from the reverse side of the slide platform 100 through a hole formed therein and screwing it into the fixed shaft 146.

The processing platform 155 is formed in an annular shape and is provided with an engagement step section 157 on an upper part, and the engagement section 157 is engaged with a metal ring 159. This metal ring 159 has a beveled edge 160 which is useful to bend the peripheral edge 203 of the front cover 201 onto the peripheral edge 209 of the rear cover 205 while inducing the peripheral edges of the design paper 211 and the cover (sheet) 213 to turn over between the peripheral edge 203 of the front cover 201 and the peripheral edge 209 of the rear cover 205. Alternatively, an upper part of the processing platform 155 is directly machined into the beveled edge 160.

An upper portion of the beveled edge 160 defines an indent 161 in which the pressing portion 50 is fitted. A lower portion of the step section 157 is contiguous to a cylindrical section 162 sliding up and down along the upper wall 145 of the second table 141. The processing platform 155 also has a guide cylinder 163 vertically moving inside the peripheral wall of the second table 141.

The guide cylinder 163 is formed with a boss section 166 having a guide hole 165 through which the fixed shaft 146 of the second table 141 slides. A lower end of the guide cylinder 163 and a lower end of the cylindrical section 162 are linked together by a linking lug 167. This linking lug 167 is fitted in a long groove 169 cut into a vertical slot in the peripheral wall 145 of the second table 141. The processing platform 155 is urged upwards by the spring (elastic member) 156 wound around the shaft 146 of the second table 141.

A locator 170 serving to position the slide platform 100 is provided on the base 2. The locator 170 has an elastic plate 172 attached in the vicinity of the guide groove 6 by a screw 173, with an engagement projection 175 being formed on a lower surface of the elastic plate. The slide platform 100 is formed with first and second engagement indents 176 and 177 that are fitted on the engagement projection 175 of the elastic plate 172. If the engagement projection 175 of the elastic plate 172 engages with the first engagement indent 176 of the slide platform 100, the first lower die 110 is positioned almost directly below the upper die 40, while if the engagement projection 175 of the elastic plate 172 is engaged with the second engagement indent 177 of the slide platform 100, the second lower die 140 is positioned almost directly below the upper die 40.

Also, the engagement projection 158, which is fitted in the lower part 95*b* of the engagement shaft 95 of the switch member 80 described above, is provided on one end of the processing platform 155 of the second lower die 140. If the second lower die 140 is positioned right below the upper die 40, the engagement projection 158 engages with the lower part 95*b* of the engagement shaft 95 of the switch member 80, the half-ring shaped engagement section 83 pivots about the bearing section 75 against the elasticity of the spring 97, and the engagement projection 158 moves away from the protuberance 57 of the inner frame 51 of the upper die 40.

Reference numeral 180 denotes a cover. The cover 180 is attached to the base 2 using a screw or the like, and first and second openings 181 and 182 are formed in a front section and a rear section without obstructing a sliding path of the slide platform 100. The first lower die 110 comes in and out through the first opening 181 and the second lower die 140 comes in and out through the second opening 182. An elongated hole, through which the indication plate 73 is visible on the vertical sliding member 41, is formed in the cover 180. It is possible to confirm the position of the upper die 40 by seeing the indication plate 73 through the elongated hole. Reference numeral 190 is a cover provided on the reverse side of the base 2 for covering the reinforcement member 15.

Operation of the button manufacturing device 1 of the present invention will now be described. After the tab 102 provided on the front wall 101 of the slide platform 100 is pulled to draw the first lower die 110 through the first opening 181 in the cover 180, the front cover 201 is placed on the upper wall 115 of the first mount table 111, and then, the peripheral edge 203 of the front cover is inserted into the gap 136 between the upper wall 115 and the mount section 126. Next, the design paper 211, covered with the cover (sheet) 213, is placed on the mount section 126 of the guide table 125.

When the tab 102 of the front wall 101 is pushed to recess the slide platform 100, the engagement projection 175 of the elastic plate 172 engages with the first engagement indent 176 of the slide platform 100, and the first lower die 110 is positioned almost right below the upper die 40 while the second lower die 140 projects from the second opening 182 of the cover 180. Upon turning the operating handle 32 in one direction, the press screw shaft 30 is rotated clockwise and the press screw shaft 30 moves downwards. The pressing member 61 on the lower part of the press screw shaft 30 pushes the engagement section 83 of the switch member 80 down to lower the entire upper die 40 along with it, including the outer frame 42 and the inner frame 51. Simultaneously, the vertical sliding member 41 is moved downwards.

The pressing section 50 of the outer frame 42 engages with the guide wall 127 of the guide table 125 and bumps onto the mount section 126, and the guide table 125 is pressed downwards against the resilience of the elastic member 156. Since the inner frame 51 is shallower than the outer frame 42, it does not touch the first lower die 110. The peripheries of the cover (sheet) 213 and the design paper 211 placed on the guide table 125 one over another are bent downwards and closely juxtaposed with the peripheral edge 203 of the front cover 201 placed on the first mount table 111.

The position of the upper die 40 is visible at the indication plate 73. The beam 20, which supports and helps the press screw shaft 30 screw up and down while linked to the base to resist a reaction force that results from the pressing impact of the upper die 40 of the dynamic element against the first or second lower die, 110 or 140, of the static element, is displaced due to the reaction force that reaches a specified level as a result of the press screw shaft 30 further moving down after the dynamic and static elements are pressed, thereby preventing the reaction force from being applied beyond the level. The beam 20 is made of polycarbonate.

The press screw shaft 30 has a male screw threadably engaged with the female screw 25 in the beam 20 to give a control over the manipulation of the rotated handle, upward and downward movement of the handle. In case of an excessive press force upon pressing engagement; specifically, once the upper mold 40 or the dynamic element bumps onto the lower die, 110 or 140, or the static element, the press screw shaft 30 and the beam 20 is released from their screw joint to prevent the handle 32 from further moving down, thereby preventing the reaction force from exceeding the specified level. For instance, the press screw shaft 30 may be threaded except for a section above a predetermined position so as to prevent the press screw shaft 30 from moving down any further. In this way, it can be avoided that the upper die 40 joins the lower die 110 or 140 at undesirably high pressure.

Upon turning the operation handle 32 in the opposite or unscrewed direction, the press screw shaft 30 is reversely rotated and moved upward. Simultaneously, the upper die 40, as a whole, moves upward while the vertical sliding member 41 goes up. The front cover 201, the cover (sheet) 213 and design paper are bent down along the peripheral edge 203 of the front cover, are pulled up while still being fitted inside the peripheral wall 47 of the outer frame 42, and then are detached from the first lower die 110.

When the rear cover 205 is seated, with the peripheral edge 209 extending upward, on the upper wall 143 of the second table 141 of the second lower die 140 withdrawn out of the second opening 182 in the cover 180, the hole 207 for attaching the detachable pin 210 is protected by the indent 161 and the peripheral edge 209 is guided and positioned in an inner surface of the cylindrical section 162 of the processing platform 155.

When the tab 104 of the rear wall 103 is pushed to move the slide platform 100 backward, the engagement projection 175 of the elastic plate 172 engages with the second engagement indent 177 of the slide platform 100, the second lower die 140 is positioned almost directly below the upper die 40 and the first lower die 110 projects from the first opening 181 of the cover 180. When the second lower die 140 is positioned almost directly below the upper die 40, the engagement projection 158 engages with the lower section 95*b* of the engagement shaft 95 of the switch member 80, the semi-ring shaped engagement section 83 rotates against the resilience of the spring 97 with the bearing section 75 as a rotation center, and moves away from the projection 57 of the inner frame 51 of the upper die 40.

Upon turning the operating handle 32 in one direction, the press screw shaft 30 rotates clockwise and the press screw shaft 30 moves downwards. The pressing member 61 provided on the lower part of the press screw shaft 30 then pushes down the inner frame 51 of the upper die 40. The contact edge 53 of the inner frame 51 presses the upper edge of the front cover 201 and the front cover 201 is pushed down. After the peripheries of the cover (sheet) 213 and the design paper 211 covering the peripheral edge 203 of the front cover 201 are guided to bend inwards along the beveled edge 160 of the processing platform 155, the peripheral edge 203 of the front cover 201 is pressed against the beveled edge 160, and the processing platform 155 is pushed downwards against the resilient member 156. In this case, the front cover 201 placed between the dynamic element or the contact edge 53 of the inner frame 51 and the static element or the processing platform 155, is capable of moving relative to the contact edge 53 of the inner frame 51 in compensation for misadjustment of the vertical axis during the press molding operation.

Specifically, the inner frame 51 is partially made of plastic especially in a contact area (i.e., the contact edge 53) with the front cover 201. This enables the front cover 201 to slip on the contact edge of the inner frame 51 upon the engagement of the peripheral edge 203 of the front cover 201 with the beveled edge 160 of the processing platform, thereby compensating for the misadjustment with the vertical axis.

This is also resulted from a fact that the front cover 201 has its outer periphery curved and extended downward while the inner frame 51 of the dynamic element has an inner surface complementary in shape to fit on the curved peripheral surface.

When the processing platform 155 has its lower edge blocked by the slide platform 100 until it is no longer depressed, the peripheral edge 203 of the front cover 201 alongside the beveled edge 160 is further bent inward while the peripheries of the cover (sheet) 213 and the design paper 211 are gripped between the contact edges 209 and 203 of the rear and front covers 201 and 205, to complete the manufacturing process of the button body 200*a*.

Upon turning the operating handle 32 in the reverse direction, the press screw shaft 30 unscrews counterclockwise, moving upwards. Simultaneously, the entire upper die 40 moves upwards and the vertical sliding member 41 also slides upwards. The button body 200*a* remains loaded in the second lower die 140. The tab 104 provided in the rear wall 103 of the slide platform 100 is pulled, the second lower die 140 is taken out of the second opening 182 of the cover 180, and it is possible to simply remove the button body 200*a* from the second lower die 140.

The above described button manufacturing device forms a substantially square shaped frame comprising a beam 20, struts 16 and 17 and reinforcement member 15, which brings about enhanced strength that permits press operations within this reinforced frame. Therefore, members other than the beam 20, struts 16 and 17 and reinforcement member 15 can be integrally made of synthetic resin, so the apparatus can be made lightweight at reduced cost, and it is possible to improve productivity.

Also, turns of the press screw shaft 30 cause the upper die 40 to move downward with an associated action of the first lower die 110 or the second lower die 140 moving upward, and the button body 200*a* is shaped under a force applied by both the upper die 40 and the first lower die 110 or the second lower die 140. Therefore, the base 2 is not used to resist press molding force, which eliminates a necessity of placing the base at a stable location, and with the base 2 set unsteadily or even hand-held, the molding operation can be carried out as well. Also, since the press screw shaft 30 is used in pushing the upper die 40 down, the operating space can be reduced.

The button 200 is finished upon inserting the raised element 221 (or 231, 241) of the previously described coupling member 220 (or 230, 240) in the hole 207 of the button body 200*a* to link them together. This linking can be carried out while confirming the orientation of the insignia 215 on the button body 200*a* to attain the desired orientation when the button is mounted at a suitable position of an object such as a clothes pocket, a hat or a bag, and for that purpose, a transverse position (e.g., in the X direction, Y direction or Z direction in FIG. 11) of attachment means, such as a detachable pin, 229, clip plate 237, is altered in securing it to the rear plate of the button body 200*a*. In this way, it is possible to manufacture the button body 200*a* without paying attention to the orientation of the insignia 215 printed on the design paper 211 over the front cover 201 in relation with the position of the attachment means 229, 237, 246 secured to the rear cover 205.

Figure 22:
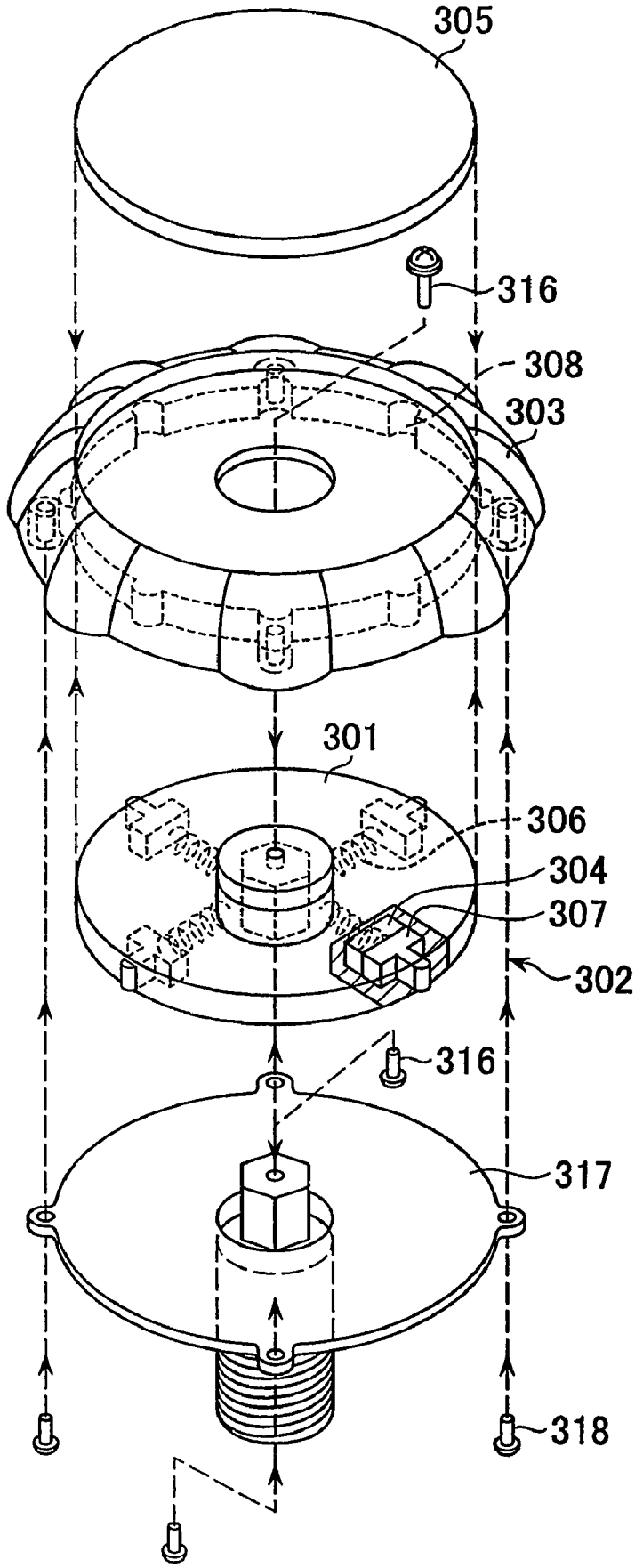
FIG. 22 is an exploded perspective view showing a clutch mechanism in a handle according to the present invention.
Figure 23:
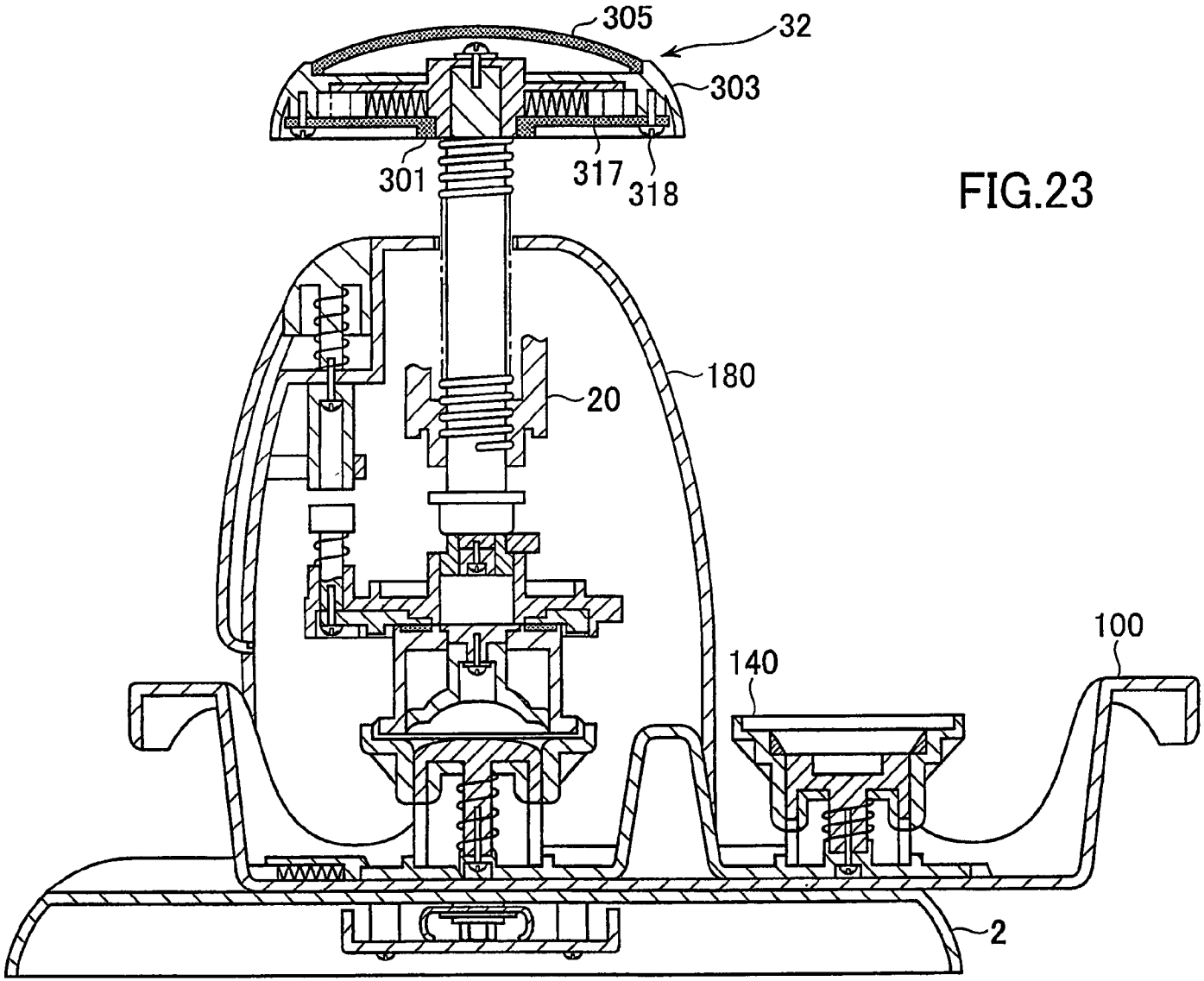
FIG. 23 is a cross sectional view showing a first preferred embodiment of the button manufacturing device having the clutch mechanism.

Referring to FIGS. 22 and 23, the exemplary operation handle in another embodiment of the present invention is illustrated.

This exemplary operating handle 32 is connected to the press screw shaft 30 by an intervening clutch mechanism 302 of which relative rotation to the screw shaft is not permitted. The clutch mechanism 302 comprises an inner member 301 coupled to the press screw shaft 30 but not rotatable relative to the same, and an outer member 303 serving as a main manipulative section of the operating handle 32. A mandrel of the inner member 301 is, in an example as shown in FIG. 22, comprised of an engagement element complementary in shape with the press screw shaft of a hexagonal cross section, and this prevents the inner member 301 from rotating relative to the press screw shaft 30. The inner member 301 has its center fixed to the top of the press screw shaft 30 by a bolt 316 while the outer member 303 is adapted to rotate relative to the inner member 301 without affecting any other elements when a turning force beyond a specified level is applied to the outer member. The outer member 303 has circular dents defined in the center, and the inner member 302 and a cover 305 concealing the top of the press screw shaft 30 are fitted in the dents on opposite sides.

As can be seen in FIG. 22, the clutch mechanism 302 includes four recessed areas 304 circumferentially positioned at every 90 degrees, four spring members 306 respectively housed in the recessed areas 304, and four engagement pieces 307 coupled to the spring members 306 and having their respective tips rounded, and used in combination with these are four additional recessed areas 308 that are defined in inner peripheral positions of the outer member 303 and are partially complementary in shape with the engagement pieces 307 to fit on. The engagement pieces 307 are elastically forced outward by the spring members 306, respectively. Thus, in ordinary conditions, the engagement pieces 307 are fitted in the recessed areas 308 in the inner surface of the outer member 303 while the tips of the engagement pieces 307 protrude beyond the outer surface of the inner member 302. Although the recessed areas 308 become narrower as they extend outwardly, the engagement pieces 307 have their respective inner halves spread like shoulders and blocked at entrances of the recessed areas 308 to withhold outward advancement any farther. Also, as can be seen in FIG. 22, the inner member 301 has its recessed areas cut clear at the upper surface, and with the spring members 306 and the engagement pieces 307 accommodated therein, the inner member 301 is overlaid with the outer member 303 and fixed to the outer member 303 together with a disk 317 by screws 318. When the engagement pieces 307 are fitted in the recessed areas 308 of the outer member 303, both the inner and outer members 301 and 303 are rotatable in the unit, and thus, the turning force is transmitted to the press screw shaft 30 through a power propagating path from the outer member 303 to the engagement pieces 307 and to the inner member 301. When this turning force is above the specified level, this force helps the engagement pieces 307 keep themselves recessed against the push of the spring members 306, and this excessive turning force resultantly releases the engagement pieces 307 from the recessed areas 308, which additionally causes the outer member 303 to rotate independent of the inner member 301 and the press screw shaft 30.

Thus, the force applied to the rotary handle is not excessively applied to the press screw shaft 30, and after the dynamic and static elements are joined under the desired pressing force, further advancement of the press screw shaft 30 is effectively stopped to eliminate any trouble due to an excessive force.

As will be recognized in FIG. 23, the button manufacturing device in this embodiment includes a cover 180 that serves to prevent access to the work range of the dynamic element (the upper die 40) and the static element (the lower die 140). Any of the static elements, when engaged with the dynamic element, are protected by this exemplary cover 180 while the remaining part of the static element apart from the dynamic element is accessible. Thus, only one of the first lower die 110 and the second lower die 140 is accessible at a time.

Inaccessibility to one of the lower dies cooperating with the dynamic element ensures safety to an operator while accessibility to the other outside the cover is provided, and hence, the operator can perform any task around the external lower die, such as setting of parts, unloading of them, etc., as desired.

It should be noted that reciprocal movement of the slide platform 100 enables the first and second lower dies to alternatively reach the work range with the dynamic element.

The cover 180 is attached to the base 2 by fastener such as screws and has first and second openings 181 and 182 in its front and rear sections without obstructing a sliding path of the slide platform 100; i.e., the first lower die 110 comes in and out through the first opening 181 and the second lower die 140 comes in and out through the second opening 182. An elongated hole, which makes the indication plate 73 visible on the vertical sliding member 41, is formed in the cover 180, and it is possible to confirm the position of the upper die 40 by seeing the indication plate 73 through the elongated hole.

Figure 24:
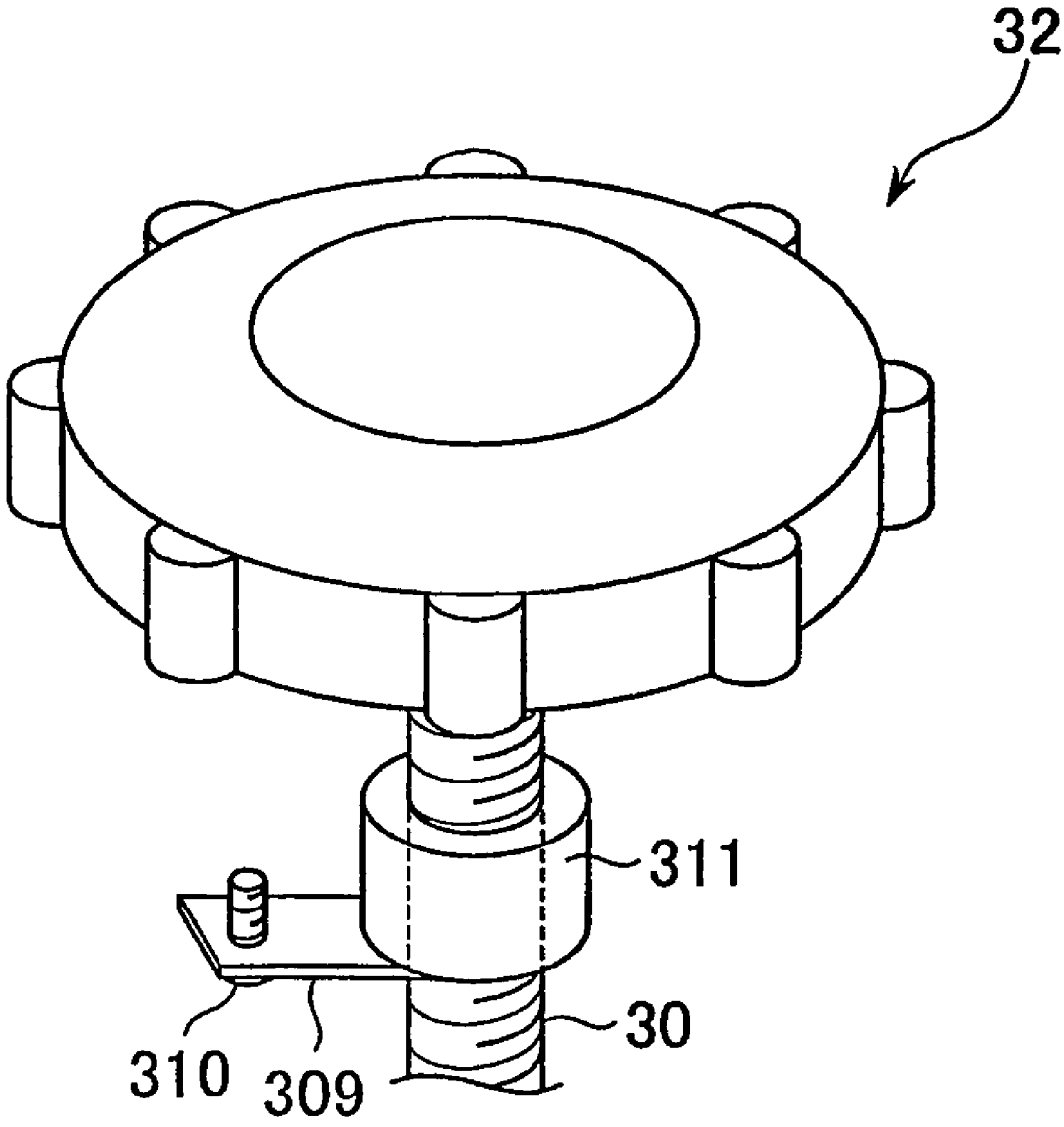
FIG. 24 is a perspective view showing a movable element of an alarm means applied to the handle.
Figure 25:
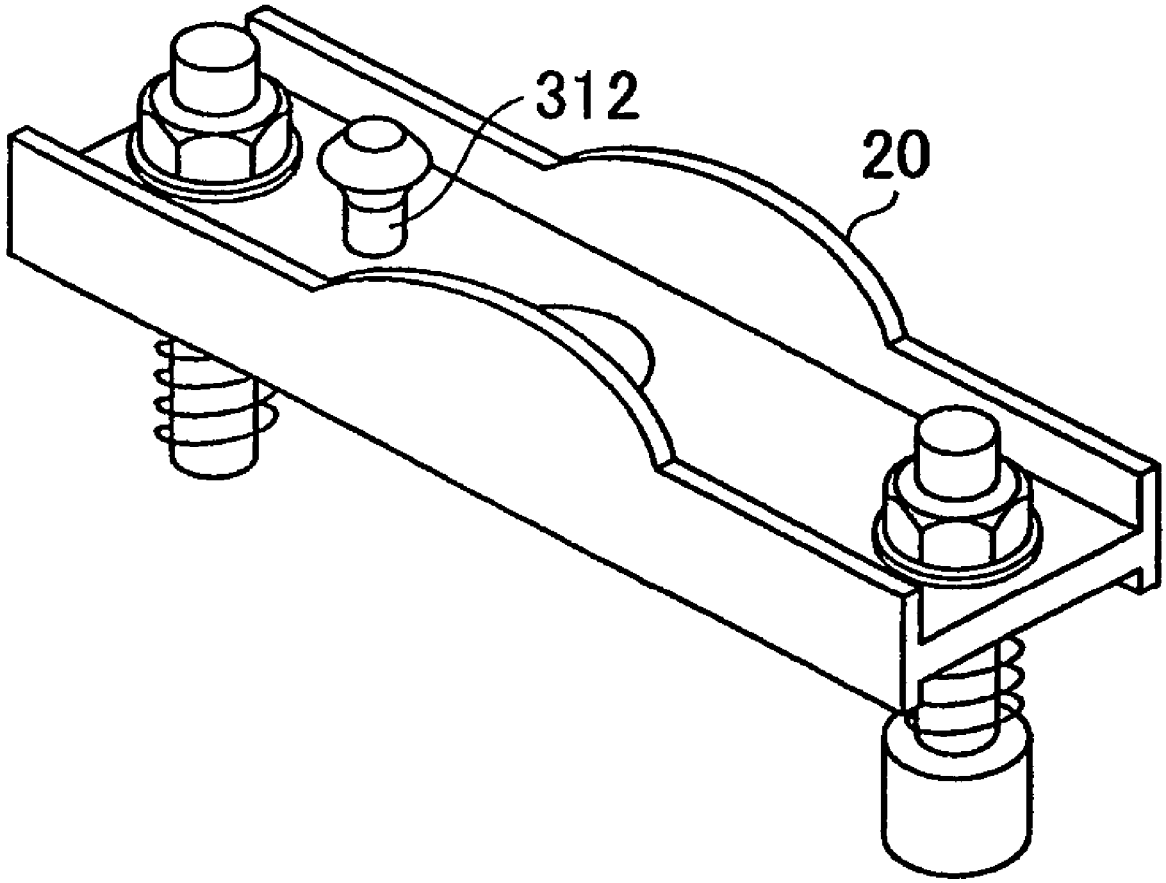
FIG. 25 is a perspective view showing a knob of the alarm means provided in a beam.
Figure 26:
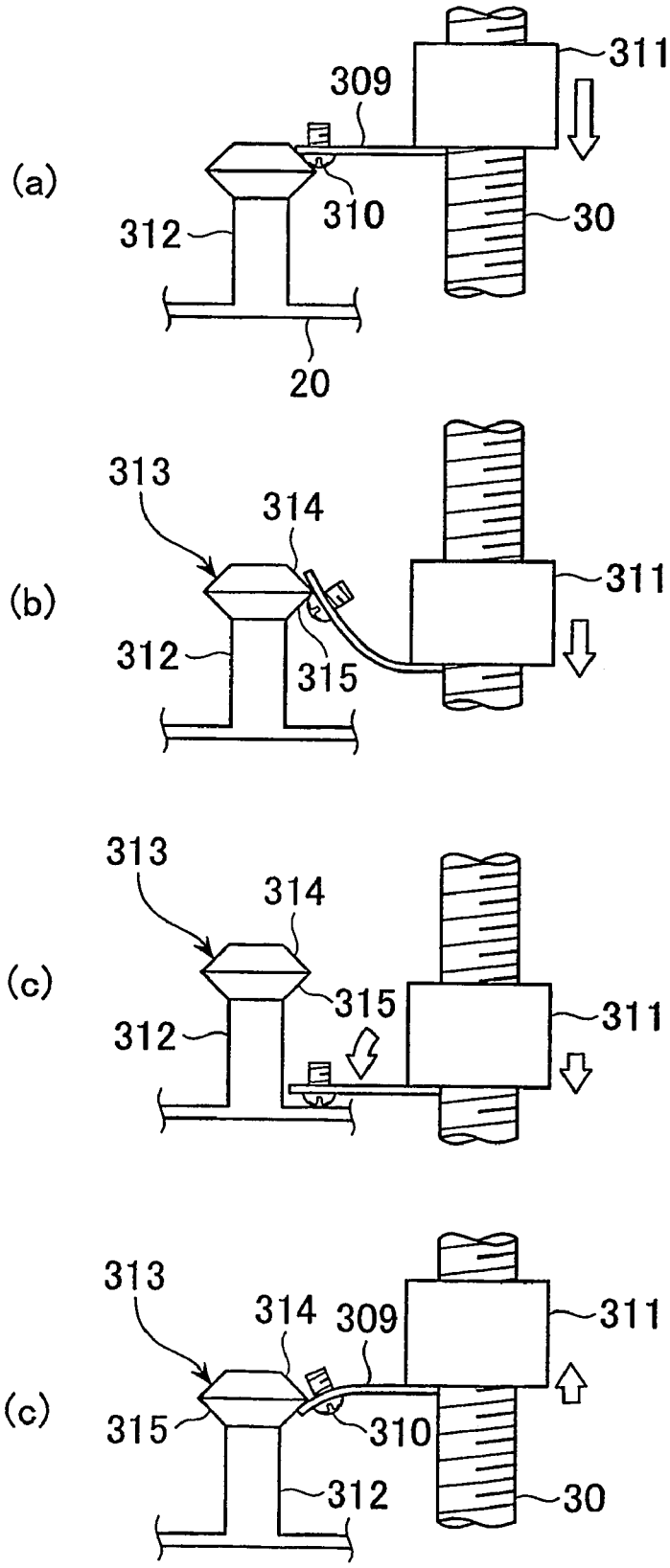
FIG. 26 is schematic side view illustrating a series of actions of the alarm means.

Referring to FIGS. 24 to 26 illustrating a modification of the embodiment according to the present invention, an alarm means is provided to let the operator know that the press screw shaft 30 has been fully advanced to attain the desired engagement of the dynamic and static elements.

The alarm means, which is applied to the press screw shaft 30, is comprised of a horizontally extending movable member and a knob fixed to the beam 20, and it gives an alarm to report an attainment of the desired engagement that is determined by a certain manner of contact of the movable member with the knob during the advancement of the press screw shaft 30.

This exemplary movable element consists of a cylindrical seat 311 fixed to the press screw shaft 30, a leaf spring 309 horizontally extending from the cylindrical seat 311, and a hammer 310 at the tip of the leaf spring 309. The stud, which is fixed to the beam 20, consists of a stem 312 fixed to the beam and a head 313 at the top of the stem 312 being of a biconical shape. In this case, the head 313 is composed of a pair of truncated cones 313 and 314 of which wider sides are joined into the disk that radially extends, having upper and lower halves tapered upward and downward, respectively. As the press screw shaft 30 is advanced, the hammer 310 of the movable member, which is made of a screw, hits a beveled surface 314 of the head 313, and further advancement of the press screw shaft 30 bends the leaf spring 309 and causes the hammer 310 to slide down onto a beveled surface 315 of the head 313. Still further advancement of the press screw shaft 30 results in a snap recovery of the leaf spring, which causes the hammer 310 to bounce onto the upper surface of the beam 20, making a snapping sound. At this instance, the desired press engagement has been attained between the dynamic element and the static element carrying the button under processing. By this sound, the operator knows that the appropriate press engagement has been achieved. In this way, the operator, on the snapping sound, stops applying additional force to the handle since he or she now knows the press molding is complete. Without undesired load to the device, adverse effects upon the device such as damage against parts can be effectively avoided.

After the completion of the press molding by the dynamic and static elements adequately engaged with each other, reversing the press screw shaft 30 causes the leaf spring 309 to strike the beveled surface 315 of the head 313, resulting in a scratch sound of the leaf spring recovered from its deflected position over the edge of the head. This scratch sound lets the operator know that the dynamic and static elements are disconnected from each other.

INDUSTRIAL APPLICABILITY

As has been described above, the button of the present invention has the advantage that it is possible to select an attachment position of the attachment means such as a detachable pin for mounting the button on an article according to the orientation of an insignia attached to the button body, because it is possible to secure the button to the button body in a position of attachment means such as a detachable pin or clip etc, for attaching the button to an article which is to be worn on, such as clothing, a hat or a bag, so as to be in a direction to cross a rear plate of the button body while confirming the orientation of the insignia, which is a logotype or a design attached to the button body. Therefore, when manufacturing a button body with a conventional button manufacturing device, it was necessary to carry out the manufacture while confirming the orientation of the insignia relative to the button body and the position of attachment means. The structure of the button of the present invention saves the work normally required to confirm the relationship between orientation of the insignia and position of the attachment means to be eliminated, thus manufacture is simplified. Further there is the advantage that no defective product is produced where the relationship between insignia orientation and position of the attachment means is inappropriate.

Also, the button of the present invention has a variety of selection of attachment means, such as a detachable pin, a clip or a magnet, which means that it is possible to select the method of attachment in line with the article the button is to be worn on, such as clothing, a hat or a bag.

The button manufacturing device of the present invention has been reinforced by using a substantially square frame using a reinforcement member. The press operation is carried out using this strengthened frame which means that members besides the reinforcement member, such as a fixing member, struts etc., can be made of synthetic resin, making the device lightweight and inexpensive, and it is possible to improve productivity.

Also, when the press screw shaft is turned, the pressing mold is lowered, the first lower die or the second lower die is raised relative to the mold. The button body is manufactured using a pinching force from both the pressing mold and the first lower die or the second lower die. It is possible to use the button manufacturing device without attaching the base to an installation platform such as a desk. It is not necessary to install the base at such a stable location and it is also possible to carry out the operation placing the base even on an unstable place, such as while being held. Also, since the press screw shaft is used in pressing the pressing mold it is possible to reduce the operating space. In this way, it is possible to have a robust device that is lightweight and enables space reduction, where operation can be carried out without the need for unreasonable force in an unstable place, which means it can be used by a mere child. Moreover, the improved safety-oriented design protects a child user from accidentally pressing his or her finger. Additionally, the improved design of enhanced reliability prevents undesirably excessive load upon the manufacturing device after a predetermined molding procedure with a button, and hence, malfunction and breakdown of the device are prevented to enhance the device reliability.

What is claimed is:

1. A button manufacturing device comprising:

a base;

a first static element;

a second static element;

a dynamic element capable of being alternatively pressed onto said first and second static elements; and a cover that prevents access to said dynamic element and one of said first and second static elements, when said dynamic element is pressed onto one of said first and second static elements, while allowing access to the other one of said first and second static elements that is outside of said cover.

2. A button manufacturing device according to claim 1, further comprising:

a platform movably disposed on said base, wherein said first and second static elements are first and second lower dies, respectively, spaced apart from each other along a path of movement of said platform, and wherein an alternative positioning of said platform enables said first and second lower dies to be alternatively aligned with said dynamic element.

* * * * *